US008366519B2

(12) United States Patent
Kume et al.

(10) Patent No.: US 8,366,519 B2
(45) Date of Patent: Feb. 5, 2013

(54) INNER SURFACE GRINDING TOOL

(75) Inventors: Masao Kume, Tochigi (JP); Koji Saito, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 372 days.

(21) Appl. No.: 12/722,917

(22) Filed: Mar. 12, 2010

(65) Prior Publication Data

US 2010/0233947 A1 Sep. 16, 2010

(30) Foreign Application Priority Data

| | | |
|---|---|---|
| Mar. 16, 2009 | (JP) | 2009-062421 |
| Mar. 16, 2009 | (JP) | 2009-062432 |
| Mar. 25, 2009 | (JP) | 2009-074404 |
| Mar. 25, 2009 | (JP) | 2009-074462 |
| Mar. 25, 2009 | (JP) | 2009-074550 |
| Mar. 25, 2009 | (JP) | 2009-074618 |

(51) Int. Cl.
*B24B 9/02* (2006.01)

(52) U.S. Cl. ..... 451/471; 451/27; 451/121; 451/155; 451/476

(58) Field of Classification Search ..... 451/471, 451/27, 470, 472, 121, 124, 155, 476, 479, 451/482, 483; 83/54
See application file for complete search history.

(56) References Cited

U.S. PATENT DOCUMENTS

| | | | | | |
|---|---|---|---|---|---|
| 1,692,661 | A | * | 11/1928 | Hutto | 451/474 |
| 1,926,835 | A | * | 9/1933 | Cook | 451/479 |
| 1,982,836 | A | * | 12/1934 | Sunnen | 451/479 |
| 1,998,460 | A | * | 4/1935 | Kline | 451/474 |
| 2,058,464 | A | * | 10/1936 | Kern | 451/474 |
| 2,791,871 | A | * | 5/1957 | Johnson | 451/478 |
| 2,812,624 | A | * | 11/1957 | Billeter | 451/485 |
| 2,815,615 | A | * | 12/1957 | Sunnen | 451/470 |
| 3,550,331 | A | * | 12/1970 | Watts | 451/474 |
| 3,707,810 | A | * | 1/1973 | Grosseau | 451/478 |
| 5,527,214 | A | | 6/1996 | Estabrook | |
| 5,695,390 | A | * | 12/1997 | Mizuno et al. | 451/124 |
| 6,139,414 | A | * | 10/2000 | Domanski et al. | 451/471 |
| 6,179,700 | B1 | * | 1/2001 | Lalone et al. | 451/464 |
| 6,527,620 | B1 | * | 3/2003 | Moellenberg et al. | 451/5 |
| 6,551,178 | B1 | * | 4/2003 | Tanaka et al. | 451/180 |

FOREIGN PATENT DOCUMENTS

| | | | |
|---|---|---|---|
| DE | 102004047520 | * | 9/2004 |
| DE | 102004047520 | | 4/2006 |
| JP | 6-190713 | | 7/1994 |

* cited by examiner

*Primary Examiner* — George Nguyen
(74) *Attorney, Agent, or Firm* — Rankin, Hill & Clark LLP

(57) ABSTRACT

An inner surface grinding tool is provided with a plurality of machining units for simultaneously machining inner surfaces of a plurality of portions of a workpiece. The plurality of machining units respectively include expanding and contracting mechanisms and grinding blade portions. In the respective machining units, outer diameters of the respective grinding blade portions are capable of individually expanding and contracting by the respective expanding and contracting mechanisms.

12 Claims, 26 Drawing Sheets

INNER SURFACE GRINDING TOOL

BACKGROUND OF THE INVENTION

1. Field of the Invention

The present invention relates to an inner surface grinding tool which is suitable for precision machining, for example, a plurality of journal bearings of an engine, in a simultaneous fashion.

2. Background Art

As a technique for increasing diametric machining accuracy by expanding and contracting a diameter of a machining tool in grinding an inner surface of a workpiece, there is known a technique in which a diameter of a grinding tool is controlled by a cam member which is driven by an expansion threaded rod, for example, when cylinder bores of an engine are individually machined. (refer to JP-A-06-190713, for example).

In addition, in machining, journal bearing portions which bear a crankshaft of an engine, for example, there may be a case where a simultaneous multiple-position machining inner surface grinding tool is used which simultaneously machines a plurality of machining target portions.

In these related-art techniques, however, in a simultaneous multiple-position machining inner surface grinding tool which machines simultaneously a plurality of holes, since there is no technique for individually controlling diameters of grinding blade portions, in controlling the diameters thereof uniformly, for example, there has been caused a problem that diametric accuracy varies due to a rigidity of the workpiece, influence by a variation in initial cutting capabilities of the grinding blade portions or degree of propagation of wear in the grinding blade portions. In addition, in machining journal bearing portions with a simultaneous multiple-position machining tool which has no general expanding and contracting mechanism, in order to prevent a finished surface from being damaged from an interference of the simultaneous multiple-position machining inner surface grinding tool with the finished surface when the same tool is pulled out of a central hole in the workpiece, the simultaneous multiple-position machining inner surface grinding tool is designed to be inserted into and pulled out of the central hole in the work piece with an arbor center offset relative to a workpiece center. Due to this, only one tool can be mounted for each journal bearing portion, resulting in a problem that the machining efficiency is deteriorated.

Further, in simultaneously machining the plurality of journal bearing portions, since the total length of the machining target portions becomes long, the overall length of the arbor also becomes long inevitably. Moreover, in the related-art inner surface grinding tools, since it is difficult for the grinding blade portions to be laid out in opposing positions relative to the axis of the arbor, no balanced machining has been able to be implemented. Because of this, the arbor has to be subjected to a plurality of machining loads simultaneously from one direction and hence becomes easy to be deformed, leading to a problem that a required or designed accuracy becomes difficult to be obtained.

SUMMARY OF THE INVENTION

One or more embodiments of the invention provide a tool for machining a plurality of machining target portions such as journal bearing portions of a multi-cylinder internal combustion engine which can not only realize an increase in machining efficiency by machining the machining target portions simultaneously but also ensure machining accuracy at all the bearing portions.

According to one or more embodiments of the invention, an inner surface grinding tool is provided with a plurality of machining units for simultaneously machining inner surfaces of a plurality of portions of a workpiece. The plurality of machining units respectively include expanding and contracting mechanisms and grinding blade portions. In each of the machining units, an outer diameter of corresponding grinding blade portion can individually be expanded or contracted.

In the event that the respective outer diameters of the grinding plate portions are made to individually be expanded or contracted, during machining journal bearing portions by taking steps of inserting and pulling the inner surface grinding tool into and out of the workpiece with the diameters of the grinding blade portions contracted, the drawback is corrected that the finished surface is damaged by the same tool when it is pulled out of the finished workpiece. This obviates the necessity of inserting and pulling the grinding tool into and out of the workpiece with the axis of the arbor offset as in the related-art grinding tools. Therefore, the series of machining steps can be performed with good efficiency. In addition, by the respective outer diameters of the grinding blade portions being controlled in accordance with the degree of propagation of wear at the grinding blade portions or rigidities at the machining target portions, a variation in diametrical accuracy can be prevented.

The expanding and contracting mechanism may be made up of an internally threaded member which is free to advance or retreat by rotations of an externally threaded member and engagement portions provided on the grinding blade portions for engagement with a slope portion on the internally threaded member, so that the diameters of the grinding blade portions are freely expanded or contracted by rotations of the externally threaded member.

As this occurs, in each machining unit, the grinding blade portion may have two or more blades which are disposed at equal angular intervals in a circumferential direction of a tool axis. In addition, in each expanding and contracting mechanism, a motor, which constitutes a power supply for rotating the externally threaded portion, is provided for each machining unit, and the motors may be made to be controlled individually by a control unit.

By adopting the construction described above, constructions similar thereto become easy to be aligned in series so as to be integrated into a compact assembly. In addition, the expanding and contracting mechanism needs neither a spring nor an elastic member. Since the grinding blade portions are disposed symmetrically with each other with respect to the axis of the arbor, a good rotation balance can be provided, whereby the grinding blade portions can rotate at high speeds, thereby increasing the machining efficiency of the grinding tool. As a result of this, the machining accuracy thereof is also increased.

In the inner surface grinding tool comprising the plurality of machining units, by individually expanding or contracting the respective outer diameters of the grinding blade portions by the respective expanding and contracting mechanisms of the machining units, the procedure of inserting and pulling the inner surface grinding tool into and out of a machining target hole in the workpiece can be simplified. At the same time, the respective outer diameters of the grinding blade portions can individually be controlled in accordance with respective conditions of the grinding blade portions, thereby making it possible to prevent the variation in diametrical accuracy.

The expanding and contracting construction includes the rotatable externally threaded member and the internally threaded member having the slope portion, so that the outer diameter of the grinding blade portion is made to be freely expanded or contracted by rotations of the externally threaded member. In addition, in the event that the two or more grinding blade portions are provided around the tool axis at equal angular intervals in the circumferential direction thereof at each machining unit and the motor constituting the power source for rotating the externally threaded member is provided at each machining unit, the similar constructions can easily be aligned in series and hence can be integrated into the construction which is compact in the axial direction and is well balanced in the rotational direction. As a result, the rotational balance can easily be increased, thereby the machining efficiency and machining accuracy of the inner surface grinding tool be improved.

The inner surface grinding tool may comprise a control shaft which is disposed rotatably at the axial center of the inner surface grinding tool. As a result, the inner surface grinding tool may be constructed so that each machining unit may have an electromagnetic clutch which engages and disengages the connection between the control shaft and the externally threaded member. Therefore, when the rotation of the control shaft is transmitted to the externally threaded member by engaging the connection between the control shaft and the externally threaded member via the electromagnetic clutch, the outer diameter of each grinding blade portion is freely expanded or contracted by the expanding and contracting mechanism.

The grinding blade portion is constructed so as to be expanded or contracted. The control shaft which is installed rotatably at the center of the tool axis and a threaded speed reduction mechanism are independently brought into connection with or disconnection from each other via the corresponding electromagnetic clutch so that the rotation of the control shaft is controlled so as to be transmitted to the threaded speed reduction mechanism. Therefore, the grinding blade portion is expanded or contracted by the corresponding expanding and contracting mechanism. By adopting this construction, neither a spring nor an elastic member is required at the expanding and contracting mechanism, whereby the machining units can be integrated into the construction which is compact in the axial direction.

The rotation of the control shaft may be controlled so as to be in or out of phase with the rotational speed of the tool. By controlling the rotation of the control shaft so as to be in or out of phase with the rotational speed of the tool, the control shaft can be easily rotated forwards or backwards in a suitable fashion.

The inner surface grinding tool may be provided with a plurality of drawbars which are respectively provided on the plurality of machining units The drawbars are disposed around the tool axis at predetermined angular intervals in the circumferential direction. The drawbars are made free to advance or retreat along the axial direction of the tool. The expanding and contracting mechanism may be configured so that each expanding and contracting mechanism has a sliding slope member which is attached to a distal end portion of the corresponding draw bar and an engagement portion which is provided on the corresponding grinding blade portion for engagement with the sliding slope member, so that the grinding blade portion is expanded or contracted by the advancing or retreating motion of the sliding slope member. In this construction, the expanding and contracting mechanism requires neither a spring nor an elastic member, whereby the plurality of machining units can be integrated into the construction which is compact in the axial direction of the inner surface grinding tool.

In the plurality of drawbars, at least two or more drawbars which are disposed around the tool axis at equal angular intervals in the circumferential direction thereof may be made to advance or retreat altogether so as to expand or contract the grinding blade portions of the same machining unit. In this way, disposing the drawbars for expanding or contracting the grinding blade portions of the respective machining units at such equal angular intervals means that the grinding blade portions of the respective machining units are disposed at equal angular intervals in the circumferential direction relative to the axis of the arbor. As a result, a good rotational balance is provided at the time of machining, and the grinding blade portions can rotate at high speeds, thereby the machining efficiency and machining accuracy of the inner surface grinding tool be improved.

The expanding and contracting mechanism may have a sliding slope member which is free to advance or retreat along the axial direction of the tool, slope portions formed on an outer circumferential portion of the sliding slope member, and engagement portions provided on the grinding blade portions for engagement with the slop portions.

By bringing the grinding blade portions into engagement with the plurality of slope portions which are formed on the outer circumferential portion of the sliding slope portion and are disposed thereon at equal angular intervals in the circumferential direction so that the individual grinding blade portions are expanded or contracted by the corresponding expanding and contracting mechanisms through advancing or retreating motions of the sliding slope member, the machining units can be integrated into the construction which is compact in the axial direction of the inner surface grinding tool. In addition, in this construction, the expanding and contracting mechanism requires neither a spring nor an elastic member, and the grinding blade portions are disposed at the equal angular intervals relative to the axial center of the arbor. This provides a good rotational balance, whereby the grinding blade portions are allowed to rotate at high speeds to thereby improve the machining efficiency of the inner surface grinding tool. As a result, the machining accuracy thereof is also improved.

The inner surface grinding tool may comprise a plurality of drawbars for causing the respective sliding slope members to advance or retreat. The plurality of drawbars may be disposed along the tool axis. The plurality of drawbars may have diameters which differ from one another and may be coaxially disposed.

For example, diameters of the drawbars which are positioned farther from a driving portion for driving the drawbars to advance or retreat are made smaller while diameters of the drawbars which are positioned nearer to the driving portion are made larger so that the drawbars are sequentially inserted through a tubular portion of the grinding tool. Therefore, all drawbars can be disposed on the tool axis, as a result of which the inner surface grinding tool can be configured as a compact unit. As this occurs, the drawbar positioned nearest to the driving portion does not have to be formed into a tubular shape.

The inner surface grinding tool may be provided with a simultaneous driving mechanism for causing all sliding slope members to advance or retreat altogether at one time and an individual driving mechanism for causing the sliding slope members to advance or retreat individually.

The individual driving mechanism may have a plurality of pinion gears which are brought into meshing engagement with face gears of externally threaded members which mesh with internally threaded portions of the sliding slop members.

According to the construction described above, when individually expanding or contracting the individual grinding blade portions, the pinion gears are brought into meshing engagement with the corresponding face gears of the externally threaded members which mesh with the internally threaded portions of the sliding slope members and the pinion gears are then driven. Therefore, the individual sliding slope members are caused to advance or retreat individually so as to expand or contract the corresponding grinding blade portions by the expanding and contracting mechanisms. In addition, the construction for expanding or contracting individually the grinding blade portions can be made simple by adopting the pinion gears.

The inner surface grinding tool may be provided with a control shaft which is free to advance or retreat in the axial direction of the tool and a plurality of spline pieces which are provided for the respective plurality of machining units and which are mounted on the control shaft. The spline pieces may be disposed so that all spline pieces can be brought into simultaneous engagement with all externally threaded members by causing the control shaft to advance or retreat.

The inner surface grinding tool may be provided with a control shaft which is free to advance or retreat in the axial direction of the tool and a plurality of spline pieces which are provided for the respective machining units and which are mounted on the control shaft. The spline pieces may be disposed so that specific spline pieces can individually be brought into engagement with specific threaded speed reduction mechanisms in accordance with a sliding position of the control shaft. In this way, by bringing the specific spline pieces into engagement with the specific threaded speed reduction mechanisms so as freely expand or contract the outer diameters of the grinding blade portions of specific machining units, the respective outer diameters of the grinding blade portions can individually be controlled in accordance with rigidities of machining target portions of a workpiece, thereby making it possible to prevent any variation in diametric accuracy.

The inner surface grinding tool may be provided with a control shaft which is free to advance or retreat in the axial direction of the tool, a plurality of primary spline pieces which are provided for the respective machining units and which are mounted on the control shaft, and a plurality of secondary spline pieces which are provided for the respective machining units and which are mounted on the control shaft. The primary spline pieces may be disposed so that all primary spline pieces can be brought into simultaneous engagement with all externally threaded members by causing the control shaft to advance or retreat. The secondary spline pieces may be disposed so that specific secondary spline pieces can be brought individually into engagement with specific threaded speed reduction mechanisms in accordance with a sliding position of the control shaft. By including both the spline pieces (the primary spline pieces) for simultaneously expanding or contracting the grinding blade portions of all the machining units and the spline pieces (the secondary spline pieces) for individually expanding or contracting the specific machining units, the grinding blade portions of all the machining units can be expanded or contracted altogether and only the grinding blade portions of the specific machining units can be expanded or contracted only by controlling the sliding amount (the sliding position) of the control shaft.

Other aspects and advantages of the invention will be apparent from the following description, the drawings and the claims.

BRIEF DESCRIPTION OF THE DRAWINGS

FIG. 4(*b*) shows the expanding and contracting mechanism in such a state that the diameter between the grinding blade portions is expanded.

FIG. 5(*b*) shows the whole of the inner surface grinding tool in a machining state.

FIG. 10(*b*) shows the expanding and contracting mechanism in such a state that the diameter between the grinding blade portions is expanded.

FIG. 11(*b*) shows the whole of the inner surface grinding tool in a machining state.

FIG. 19(*b*) shows the expanding and contracting mechanism in such a state that the diameter between the grinding blade portions is expanded.

28(*a*) shows the expanding and contracting mechanism in such a state that a diameter between grinding blade portions is contracted.

FIG. 35(*b*) shows a state in which the diameter between the grinding blade portions is expanded.

FIG. 36(*b*) shows the whole of the tool in a machining state.

FIG. 39(*b*) is an exploded view of the expanding and contracting mechanism in which assembled parts are disassembled with grinding blade portions and a control shaft omitted.

FIG. 41(*b*) shows the expanding and contracting mechanism in such a state that the diameter between the grinding blade portions is expanded.

DETAILED DESCRIPTION OF THE EXEMPLARY EMBODIMENTS

An inner surface grinding tool of exemplary embodiments of the invention is configured as a tool which enables an efficient machining in simultaneously machining a plurality of machining target portions such as journal bearing portions of a multi-cylinder internal combustion engine with individual machining units and improves machining accuracy at all bearing portions and in that expansion and contraction of respective grinding blade portions can be controlled separately.

First Exemplary Embodiment

Referring to FIGS. 1 to 6, a first exemplary embodiment of the invention will be described.

Figure 1:
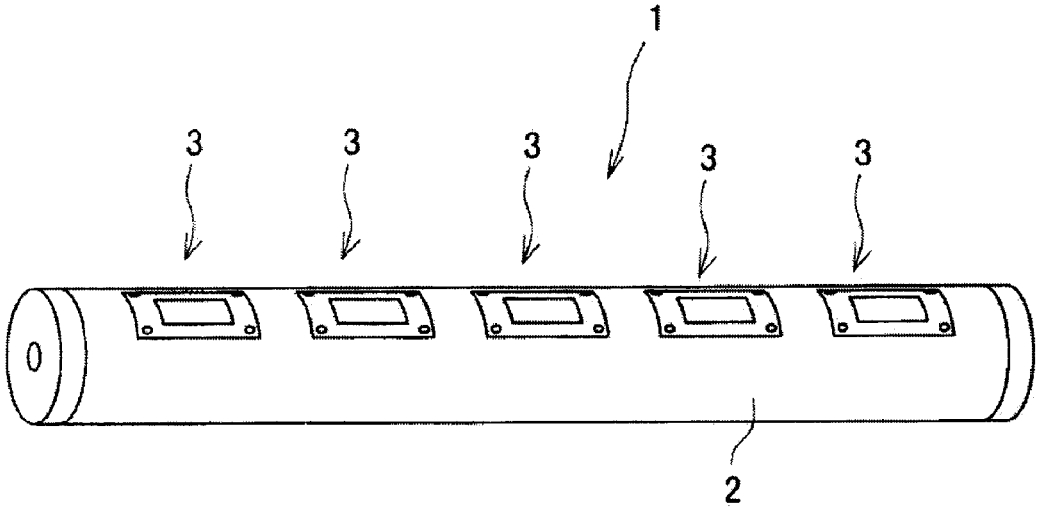
FIG. 1 is an external view of an inner surface grinding tool of a first exemplary embodiment.
Figure 2:
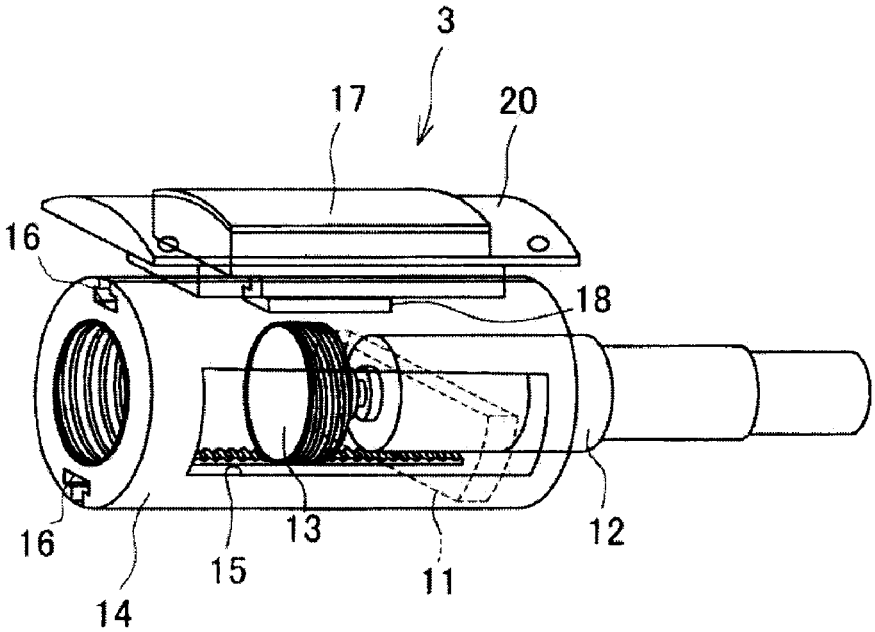
FIG. 2 is an explanatory diagram which describes an expanding and contracting mechanism of a machining unit.
Figure 3:
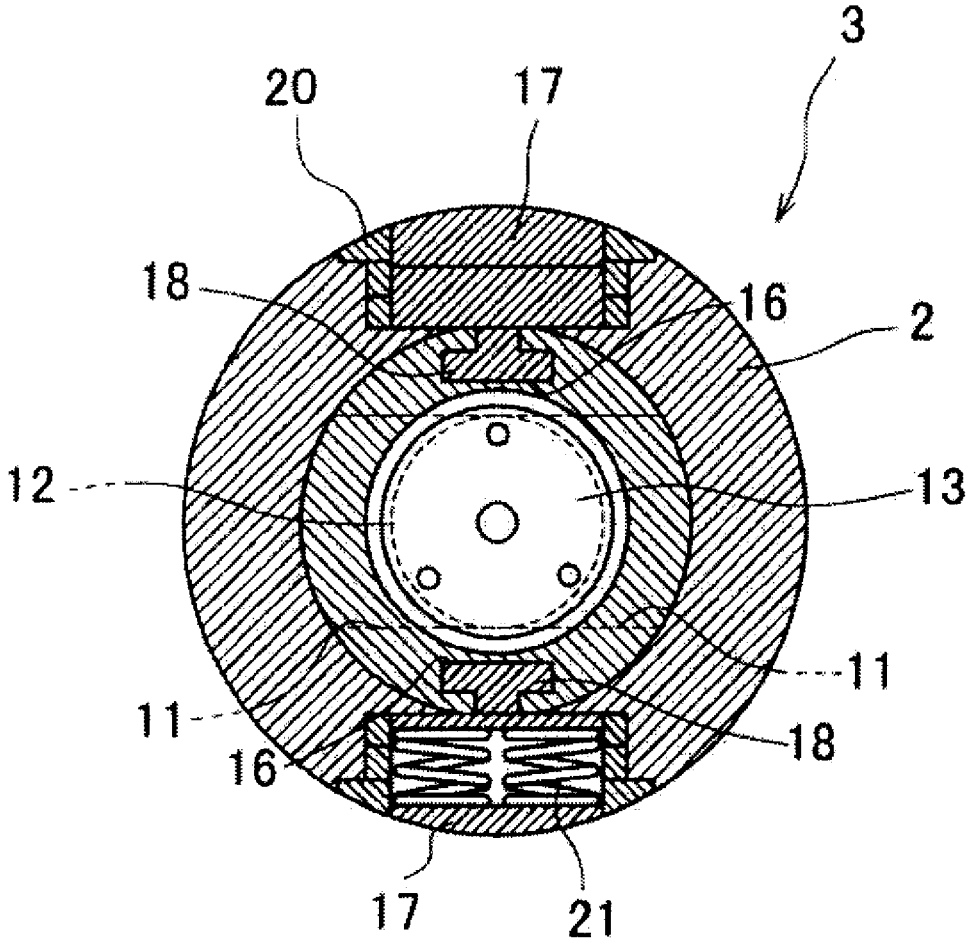
FIG. 3 is a vertical sectional view of a machining unit portion.
Figure 44:
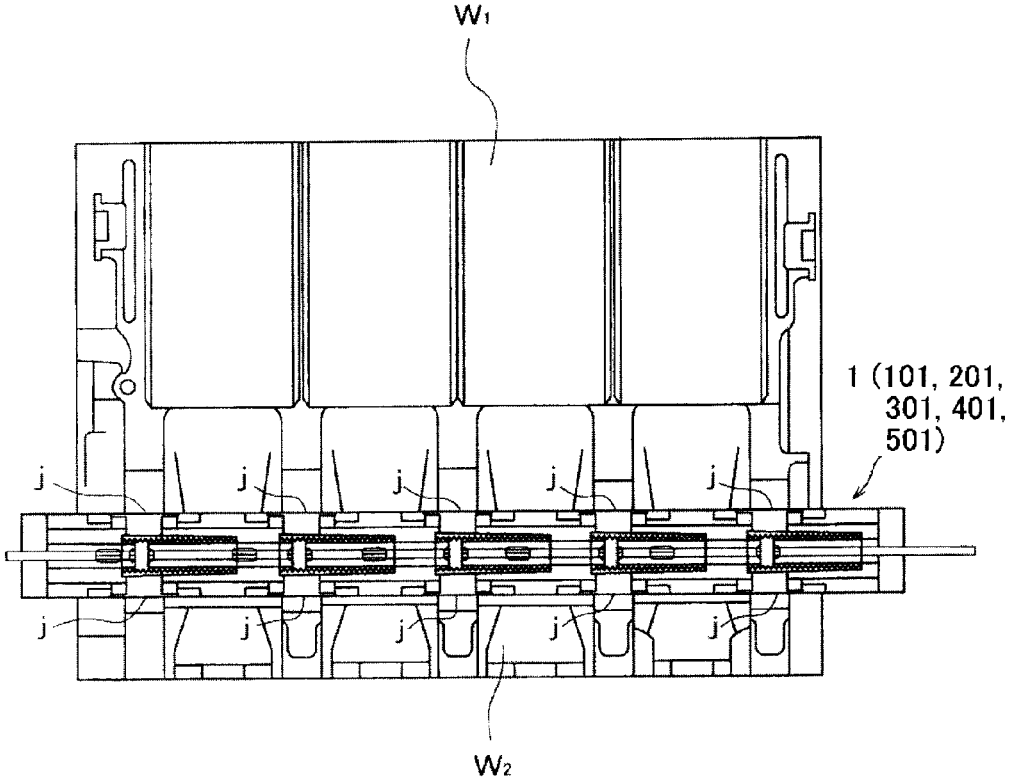
FIG. 44 is an explanatory diagram which describes a state in which five journal bearing portions of a four-cylinder internal combustion engine are machined.

As shown in FIGS. 1 to 3, an inner surface grinding tool 1 as an arbor includes five machining units 3 which are coaxially incorporated within a tubular case 2 and is designed to simultaneously machine five semicircular journal bearing portions j of a four-cylinder internal combustion engine 4 as shown in FIG. 44 which is made up of a cylinder block $W_1$ and a lower block $W_2$ with the cylinder block $W_1$ and the lower block $W_2$ fastened together.

Figure 6:
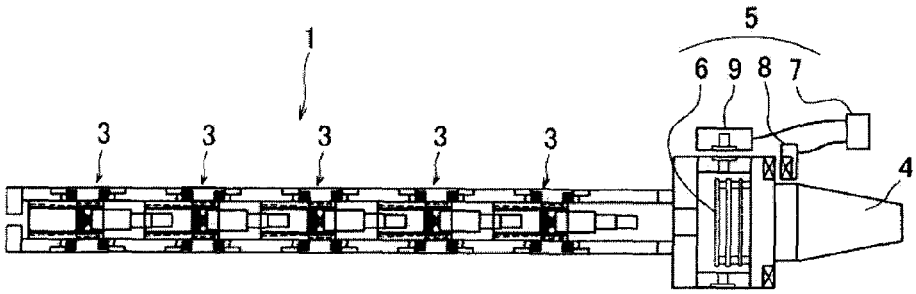
FIG. 6 is an explanatory diagram of the whole of a grinding system in which the inner surface grinding tool is mounted.

As shown in FIG. 6, according to a brief overall configuration of a grinding system to which the inner surface grinding tool 1 of the embodiment is applied, the grinding system includes a spindle motor 4 for driving to rotate the inner surface grinding tool 1 in grinding and a control unit 5 for controlling expansion and contraction of respective grinding blade portions of the machining units 3. This control unit 5 includes an NC controller 7, a control unit 6 for controlling individually the expandable diameters of the grinding blade portions of the five systems, a non-contact feeding unit 8 for controlling individually the driving of motors 12 of the machining units 3, which will be described later, in a non-contact fashion and a non-contact communication unit 9.

When adjusting individually expansion amounts of the grinding blade portions of the machining units 3 with a view to aligning respective finish machining dimensions at machining target portions, although the control unit 5 controls only the motors 12 at the machining units 3 whose expansion amounts are to be so adjusted, when inserting and pulling the grinding tool 1 into and out of a workpiece or cutting the machining target portions on the workpiece, the control unit 5 controls the motors 12 at all the machining units 3 simultaneously.

As shown in FIGS. 2, 3, the machining unit 3 includes the servo motor 12 with a speed reduction gear which is held on a motor bracket 11 which is fixed to an inner surface side of the case 2, an externally threaded member which is driven to rotate by the motor 12 and an internally threaded tube 14 as an internally threaded member which is free to advance or retreat in an axial direction through rotations of the externally threaded member 13. Windows or openings 15 through which the motor bracket 11 can be inserted are formed to extend long in the axial direction in both left and right side surface portions of the internally threaded tube 14, while sloping groove portions 16 of a dovetail groove type are formed in upper and lower symmetrical positions at an upper portion and a lower portion of the internally threaded tube 14 as sloping portions with which engagement portions 18 of grinding blade portions 17, which will be described later, are brought into engagement. In this embodiment, the sloping groove portion is inclined so as to be gradually slightly lowered from the left to the right as it so extends, as shown in FIG. 4.

The grinding blade portion 17 is integrally assembled to a grinding blade portion holder 20 so as to slide vertically relative to the grinding blade portion holder 20. The engagement portion 18, which is of a dovetail tenon type, is integrally provided inwards of the grinding blade portion 17 so as to be fitted in the dovetail groove-type sloping groove portion 16 as has been described above for engagement therewith. In addition, a grinding blade (grinding stone) is mounted on a top surface of the grinding blade portion 17, and a grinding blade portion 17 like this is installed in each of the upper and lower sloping groove portions 16 in the internally threaded tube 14.

In this embodiment, although the pair of sloping groove portions 16 and the pair of grinding blade portions 17 are provided in the symmetrical positions with respect to a tool axis which constitutes a center therebetween, three or more sloping groove portions and grinding blade portions may be provided around the tool axis at uniform angular intervals in a circumferential direction thereof.

Figure 4A:
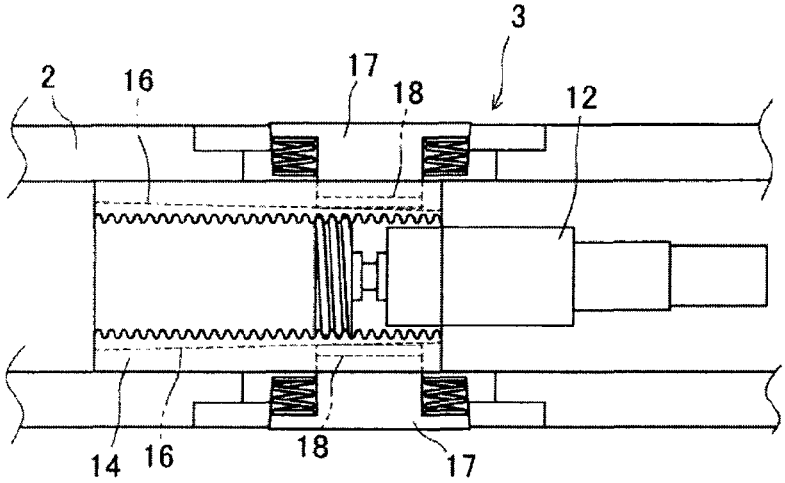
FIG. 4(*a*) shows the expanding and contracting mechanism in such a state that a diameter between grinding blade portions is contracted.
Figure 4B:
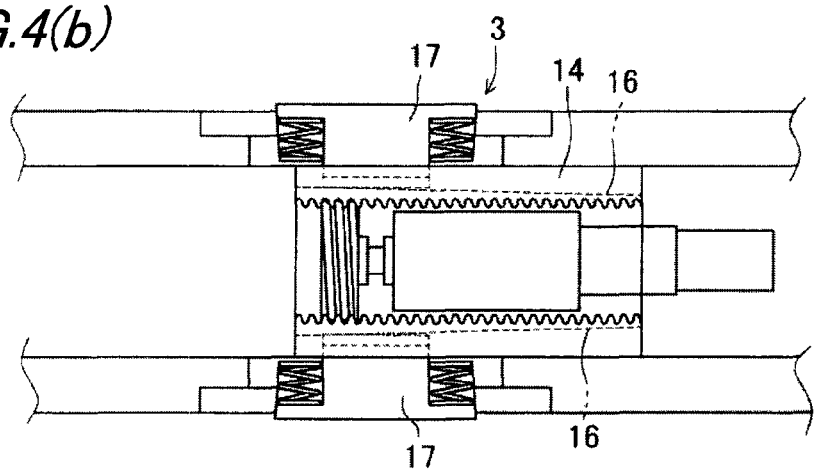

Therefore, in this embodiment, as shown in FIG. 4(*a*), when the internally threaded tube 14 moves leftwards in the figure through rotations of the motor 12, the pair of upper and lower grinding blade portions 17 is contracted diametrically inwards by the engagement portions 18 which are brought into engagement with the slightly inclined sloping groove portions 16. In contrast, as shown in FIG. 4(*b*), when the internally threaded tube 14 moves rightwards in the figure, the pair of upper and lower grinding blade portions 17 is expanded diametrically outwards. Namely, an expanding and contracting mechanism is made up of the externally threaded member 13, the internally threaded tube 14, the sloping groove portions 16 and the engagement portions 18.

A spring 21 is installed between the grinding blade portion holder 20 and the grinding blade portion 17 for absorbing looseness between the sloping groove portion 16 and the engagement portion 18.

Figure 5A:
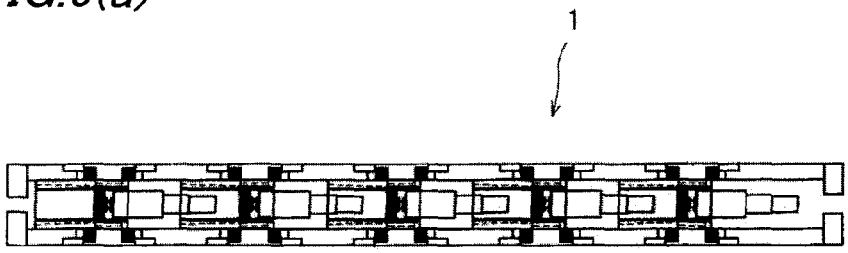
FIG. 5(*a*) shows the whole of the inner surface grinding tool in a waiting state.
Figure 5B:
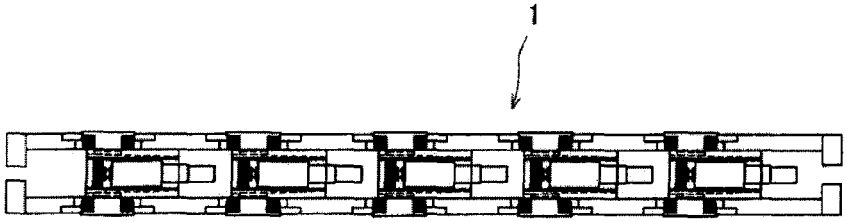

In machining journal bearing portions of a four-cylinder internal combustion engine as shown in FIG. 44, the inner surface grinding tool 1, which as been described heretofore, is inserted into journal bearing portions j which are defined by fastening a cylinder block $W_1$ and a lower block $W_2$ together in such a state that all the grinding blade portions 17 of the machining units 3 of the grinding tool 1 are contracted so as to be stored within the grinding blade portion holders 20 (FIG. 5(*a*)).

Then, when the insertion of the inner surface grinding tool 1 is completed, all the motors 12 with the speed reduction gear are driven by a signal from the control unit 5 so as to cause the externally threaded members 13 of all the machining units 3 to rotate, whereby the internally threaded tubes 14 are caused to retreat so that all the grinding blade portions 17 are caused to slide diametrically outwards for expansion (FIG. 5(*b*)). As this occurs, since the openings 15 formed in both the left and right side surface portions of the internally threaded tubes 14 are opened in an axial length which is sufficient for absorption of the sliding stroke of the grinding blade portions 17, there is no risk of the internally threaded tubes 14 interfering with the corresponding motor brackets 11.

Although cutting is implemented by driving the spindle motor 4, a balanced machining becomes possible at each machining unit 3 due to the grinding blade portions 17 being positioned vertically symmetrically, deflection by machining loads of the whole of the inner surface grinding tool 1 is reduced, and the rotational balance is made difficult to become out of order. This enables the grinding blade portions 17 to rotate at high speeds, as a result of which a reduction in machining time can be realized.

In a case where diameters of the finished machining target portions of the workpiece vary due to wear of the tool or the variation in rigidity at the machining target portions, since the expansion amounts of the grinding blade portions 17 of the individual machining units 3 can be controlled independently, the diameters of the finished machining target portions can be aligned constantly by the expanding and contracting mechanisms being combined with a function, for example, to measure finished diameters after the respective grinding blade portions 17 of the individual machining units 3 have been controlled for expansion so as to be fed back to individual target expansion diameters.

When the machining is completed, all the motors 12 with the speed reduction gear are driven to cause the corresponding externally threaded members 13 to rotate by a signal from the control unit 5 so as to cause the internally threaded tubes 14 to advance so that the inner surface grinding tool 1 is pulled out of the workpiece with the grinding blade portions 17 caused to slide diametrically inwards for contraction (FIG. 5(*a*)).

The variation in diametric accuracy of the plurality of machined holes can be suppressed by adopting the manner that has been described heretofore. Moreover, since the inner surface grinding tool 1 can be inserted into and pulled out of the workpiece with efficiency, the machining efficiency can be improved extremely well.

Second Exemplary Embodiment

Referring to FIGS. 7 to 12, a second exemplary embodiment of the invention will be described.

Figure 7:
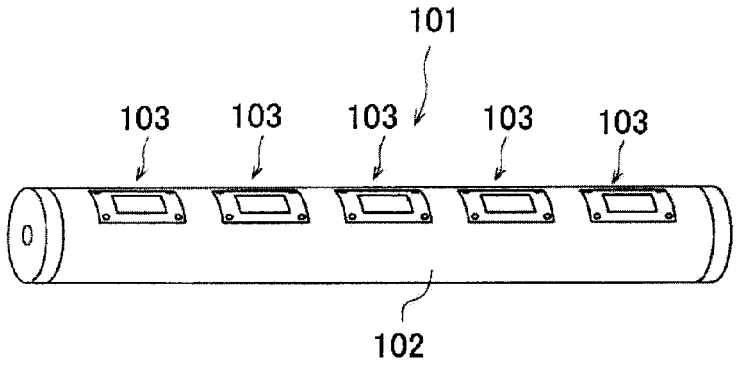
FIG. 7 is an external view of an inner surface grinding tool of a second exemplary embodiment.
Figure 8:
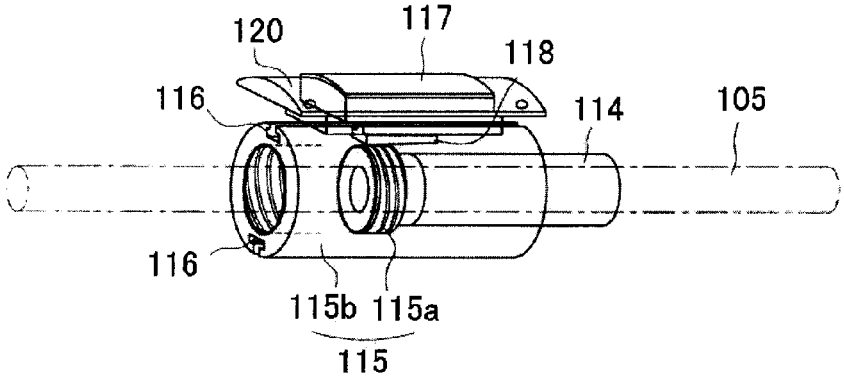
FIG. 8 is an explanatory diagram which describes an expanding and contracting mechanism of a machining unit.
Figure 9:
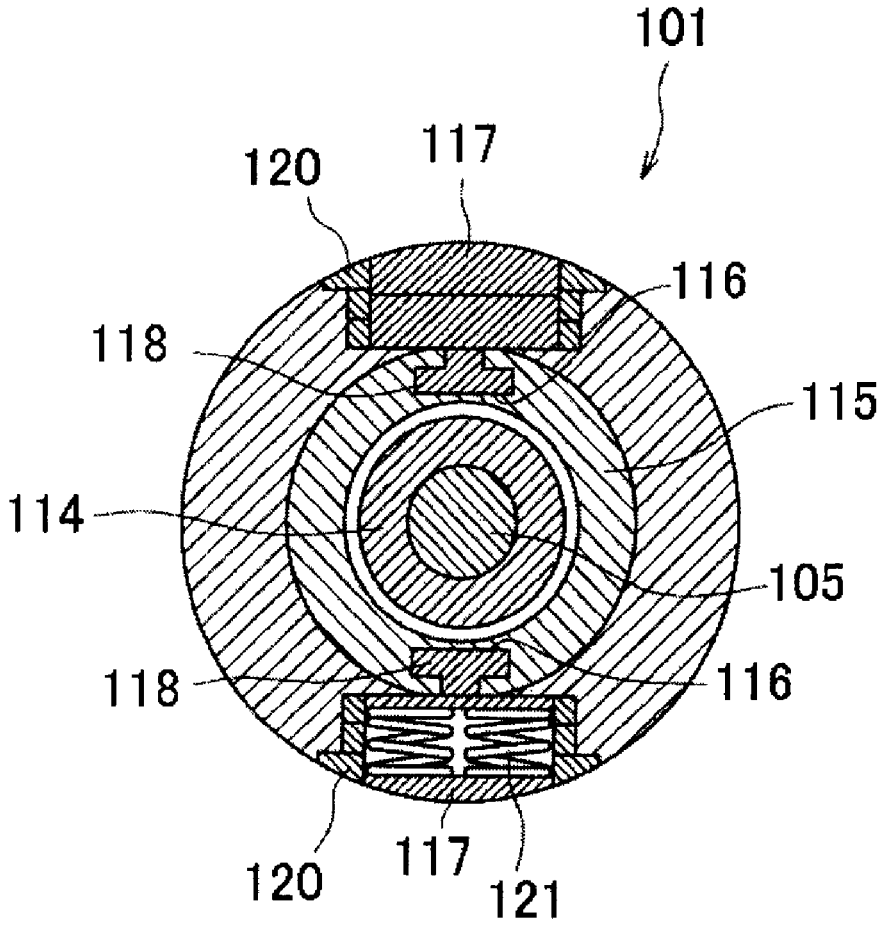
FIG. 9 is a vertical sectional view of a machining unit portion.

In the second exemplary embodiment, as shown in FIGS. 7 to 9, an inner surface grinding tool 101 as an arbor includes five machining units 103 which are incorporated coaxially within a tubular case 102 and is designed to machine simultaneously five semicircular journal bearing portions j of a four-cylinder internal combustion engine 4 as shown in FIG. 44 which is made up of a cylinder block $W_1$ and a lower block $W_2$ with the cylinder block $W_1$ and the lower block $W_2$ fastened together.

Figure 12:
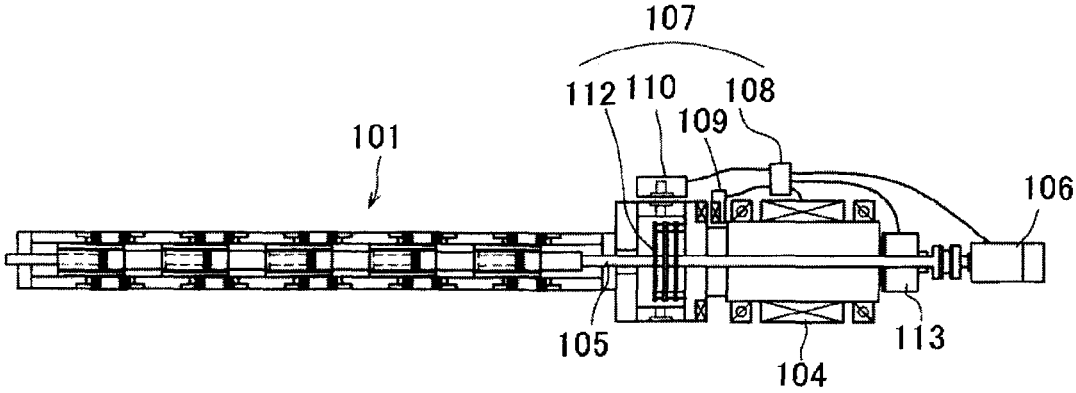
FIG. 12 is an explanatory diagram of the whole of a grinding system in which the inner surface grinding tool is mounted.

As shown in FIG. 12, according to a brief overall configuration of a grinding system to which the inner surface grinding tool 101 is applied, the grinding system includes a spindle motor 104 for driving to rotate the inner surface grinding tool 101 in grinding, a control shaft motor 106 for driving a control shaft 105 which is installed at a center of a tool axis and a control unit 107 for controlling expansion and contraction of respective grinding blade portions of the machining units 103. This control unit 107 includes an NC controller 108, a non-contact feeding unit 109 for controlling electromagnetic clutches 114 of the machining units 103, which will be described later, individually in a non-contact fashion, a non-contact communication unit 110 and a control unit 112 for controlling individually the expandable diameters of the respective grinding blade portions of the machining units 103. In addition, a rotary encoder 113 for controlling the rotational speed of the control shaft 105 is provided on an axis of the control shaft motor 106.

Then, when adjusting individually the expansion amount of the grinding blade portions of the machining units 103 with a view to aligning respective finish machining dimensions at machining target portions, the control unit 107 controls only the electromagnetic clutches 114 at the machining units 103 whose expansion amounts are to be so adjusted. When inserting and pulling the grinding tool 101 into and out of the workpiece or cutting the machining target portions on the workpiece, the control unit 107 controls the electromagnetic clutches 114 at all the machining units 103 simultaneously.

As shown in FIGS. 8, 9, the machining unit 103 includes the electromagnetic clutch 114 which is provided on the control shaft 105 so as to be positioned locally on the periphery of the machining unit 103, an externally threaded tube 115*a* of a threaded speed reduction mechanism 115 which is disposed on the periphery of the electromagnetic clutch 114 so that the electromagnetic clutch 114 is brought into engagement therewith or disengagement therefrom, and an internally threaded tube 115*b* which meshes with a thread portion of the externally threaded tube 115*a* and which is free to advance or retreat in an axial direction by rotations of the externally threaded tube 115*a*. When the electromagnetic clutch 114 is switched on so that the control shaft 105 and the externally threaded tube 115*a* are integrated with each other, the rotation of the control shaft 105 is transmitted to the internally threaded tube 115*b*. When the electromagnetic clutch 114 is switched off so that the control shaft 105 and the externally threaded tube 115*a* are disengaged from each other, the transmission of rotation of the control shaft 105 to the internally threaded tube 115*b* is cut off.

Slopping groove portions 116 of a dovetail groove type are formed in upper and lower symmetrical positions at an upper portion and a lower portion of the internally threaded tube 115*b* for engagement with engagement portions 118 of grinding blade portions 117, which will be described below. The sloping groove portion 116 is inclined along the axial direction, and in this embodiment, the sloping groove portion 116 is inclined so as to be gradually slightly lowered the left to the right as it so extends, as shown in FIG. 10(*a*).

The grinding blade portion 117 is assembled integrally to a grinding blade portion holder 120 so as to slide vertically relative to the grinding blade portion holder 120. The engagement portion 18, which is of a dovetail tenon type, is provided integrally inwards of the grinding blade portion 117 so as to be fitted in the dovetail groove-type sloping groove portion 16 for engagement therewith. In addition, a grinding blade (grinding stone) is mounted on a top surface of the grinding blade portion 117. A grinding blade portion 117 like this and the engagement portion 118 thereof are installed in each of the upper and lower sloping groove portions 116 in the internally threaded tube 115*b*.

Figure 10A:
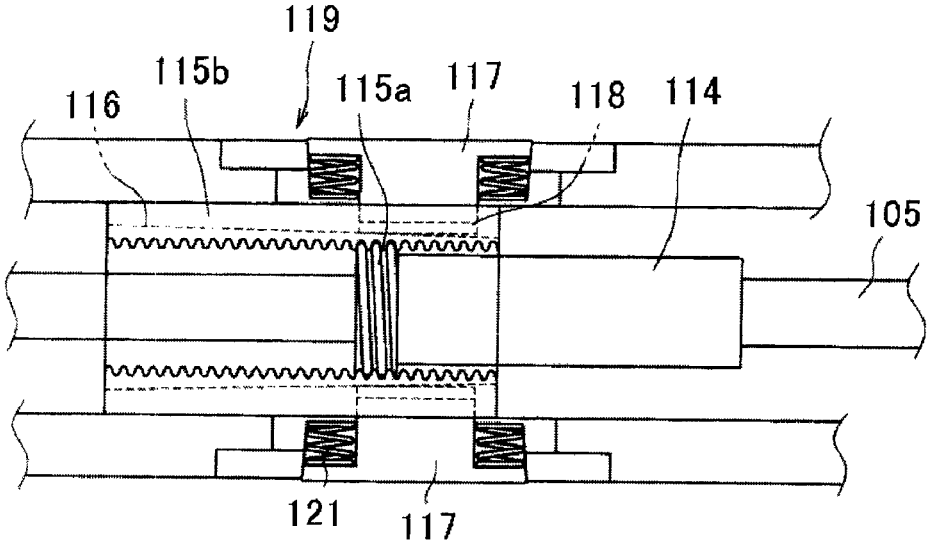
FIG. 10(*a*) shows the expanding and contracting mechanism in such a state that a diameter between grinding blade portions is contracted.
Figure 10B:
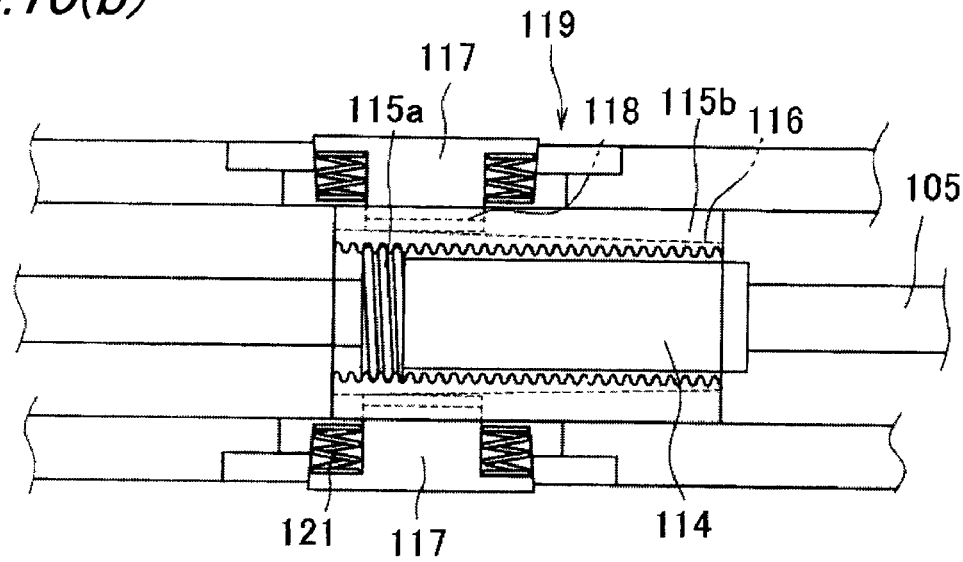

Because of this, in this embodiment, as shown in FIG. 10(*a*), when the electromagnetic clutch 114 is switched on to cause the internally threaded tube 115*b* to rotate forwards to thereby cause the internally threaded tube 115*b* to move leftwards in the figure, the pair of upper and lower grinding blade portions 117 is contracted diametrically inwards by the engagement portions 118 which are brought into engagement with the slightly inclined sloping groove portions 116. In contrast, as shown in FIG. 10(*b*), when the internally threaded tube 115*b* moves rightwards in the figure, the pair of upper and lower grinding blade portions 117 is expanded diametrically outwards. Namely, an expanding and contracting mechanism 119 is made up of the threaded speed reduction mechanism 115 which is made up, in turn, of the externally threaded tube 115*a* and the internally threaded tube 115*b*, the sloping groove portions 16 and the engagement portions 118.

A spring 121 is installed between the grinding blade portion holder 120 and the grinding blade portion 117 for absorbing looseness between the sloping groove portion 116 and the engagement portion 118.

In this embodiment, although the pair of sloping groove portions 116 and the pair of grinding blade portions 117 are provided in the symmetrical positions with respect to the tool axis which constitutes a center therebetween, three or more sloping groove portions and grinding blade portions may be provided around the tool axis at uniform angular intervals in a circumferential direction thereof.

In this embodiment, in rotating the control shaft 105, the rotation of the control shaft 105 is transmitted to the threaded speed reduction mechanism 115 so that the rotation of the control shaft 105 deviates minutely from a rotational speed at which the tool 101 rotates so as to produce a difference in phase therebetween.

Although the control shaft 105 which is positioned on an axis of the tool 101 normally rotates at the same rotational speed at which the tool 101 rotates, when expanding or contracting the grinding blade portions 117, the electromagnetic clutch 114 is switched on and the rotational speed of the control shaft motor 106 which drives the control shaft 105 is made to deviate minutely from the rotational speed of the tool 101 so as to produce a difference in phase therebetween to thereby rotate the internally threaded tube 115*b*. As this occurs, for example, the rotational speed of the control shaft 106 is made faster than the rotational speed of the tool 101 so as to advance its phase, whereby the grinding blade portions 117 can be controlled to expand. In contrast, the rotational speed of the control shaft motor 106 is made slower than the rotational speed of the tool 101 so as to delay, whereby the grinding blade portions 117 can be controlled to contract.

As this occurs, the expanding or contracting amount of the grinding blade portions 117 is in proportion to the difference in phase of rotational speed between the tool 101 and the control shaft 105. Consequently, due to this synchronous rotation control, a rotary encoder is disposed so as to be connected directly on to a spindle shaft which drives to rotate the tool 101 for detection of a rotational speed of the tool 101, and a ratio of the rotational speed of the tool 101 to a rotational speed of the control shaft motor 106 which is detected by the motor controlling rotary encoder 113 which is disposed on the axis of the control shaft motor 106 is calculated for synchronous control of the control shaft motor 106.

As an example of a rotational speed control like what has been described above, for example, assuming that pReso1=pulse resolution of the spindle encoder, pReso2=pulse resolution of the control shaft encoder, V1=rotational speed value of the spindle shaft (the number of pluses generated by the encoder per unit time), V2=rotational speed value of the control shaft (the number of pulses generated by the encoder per unit time), tAdj=expansion amount of the grinding blade portion, and k=expansion amount of the grinding blade portion per rotation of the internally threaded tube (a value converted into the pReso2 pulse resolution), the rotational speed (V2) of the control shaft motor 106 is controlled so as to establish the following two expressions (1), (2).

$$(V1 \times pReso2) - (V2 \times pReso1) + (tAdj \times k) = 0 \quad (1)$$

$$V2 = \frac{(V1 \times pReso2) + (tAdj \times k)}{pReso1} \quad (2)$$

As this occurs, since V1 and V2 represent the numbers of pulses generated from the respective encoders per unit time, in the event that the resolutions are different, resulting values are different even though rotational speeds are the same.

In addition, the constant k is calculated as expressed by the following expression (3) from the thread pitch per rotation of the internally threaded tube) and the sloping angle of the sloping groove portion 116 (the expansion amount to the sliding amount of the grinding blade portion). In the following expression, let's assume that pSq=thread pitch of the internally threaded tube and θ=sloping angle.

$$k = \frac{pReso2}{pSq \times \tan\theta} \quad (3)$$

Figure 11A:
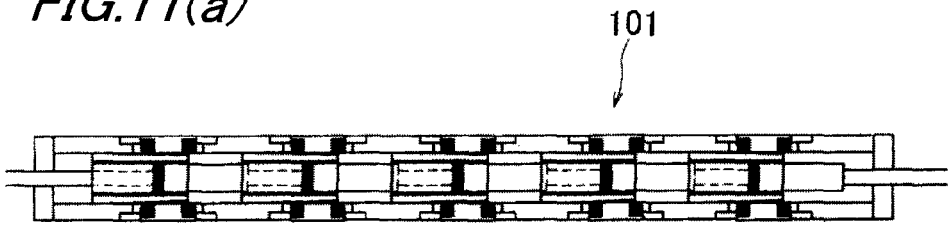
FIG. 11(*a*) shows the whole of the inner surface grinding tool in a waiting state.
Figure 11B:
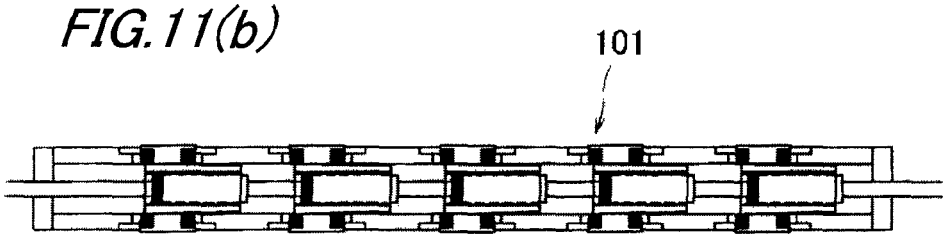

In machining journal bearing portions of a four-cylinder internal combustion engine as shown in FIG. 44, the inner surface grinding tool 101, which as been described above, is inserted into journal bearing portions j which are defined by fastening the cylinder block $W_1$ and the lower block $W_2$ together in such a state that all the grinding blade portions 117 of the machining units 103 of the grinding tool 101 are contracted so as to be stored within the grinding blade portion holders 120 (FIG. 11(*a*)).

Then, when the insertion of the inner surface grinding tool 101 is completed, all the electromagnetic clutches 114 are switched on by a signal from the control unit 107 so as to cause the externally threaded tubes 115*a* of all the machining units 103 to rotate reversely, whereby the internally threaded tubes 115*b* are caused to retreat so that all the grinding blade portions 117 are caused to slide diametrically outwards for expansion (FIG. 11(*b*)). Thereafter, all the electromagnetic clutches 114 are switched off.

Although cutting is implemented by driving the spindle motor 104, a balanced machining becomes possible at each machining unit 103 due to the grinding blade portions 117 being positioned vertically symmetrically, deflection by machining loads of the whole of the inner surface grinding tool 101 is reduced, and the rotational balance is made difficult to become out of order. This enables the grinding blade portions 117 to rotate at high speeds, as a result of which a reduction in machining time can be realized.

In a case where diameters of the finished machining target portions of the workpiece vary due to wear of the tool or the variation in rigidity at the machining target portions, since the expansion amounts of the individual machining units 103 can be controlled independently, the diameters of the finished machining target portions can be aligned constantly by the expanding and contracting mechanisms being combined with a function, for example, to measure finished diameters after the respective grinding blade portions 117 of the individual machining units 103 have been controlled for expansion so as to be fed back to individual target expansion diameters.

When the machining is completed, the externally threaded tubes 115*a* are caused to rotate forwards by a signal from the control unit 107 so as to cause the internally threaded tubes 115*b* to advance whereby the individual grinding blade portion 117 are caused to slide diametrically inwards for contraction (FIG. 11(*a*)). Thereafter, the inner surface grinding tool 101 is pulled out of the workpiece.

According to the inner surface grinding tool of the second exemplary embodiment, the variation in diametric accuracy of the plurality of machined holes can be suppressed by adopting the manner that has been described heretofore. Moreover, since the inner surface grinding tool 101 can be inserted into and pulled out of the workpiece with efficiency, the machining efficiency can be improved extremely well. In addition, the control shaft can be rotated forwards and backwards appropriately and easily by controlling the control shaft so as to rotate in synchronism with the rotational speed of the grinding tool or with the difference in phase of rotational speed provided between the tool and the control shaft.

Third Exemplary Embodiment

Referring to FIGS. 13 to 30, a third exemplary embodiment of the invention will be described.

Figure 13:
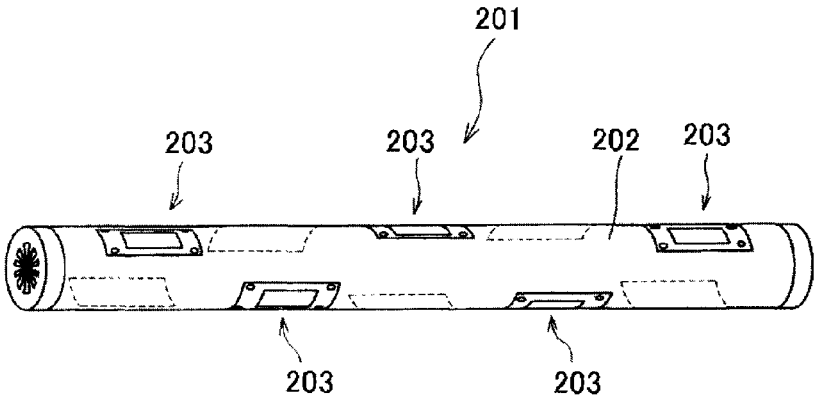
FIG. 13 is an external view of an inner surface grinding tool of a third exemplary embodiment.
Figure 14:
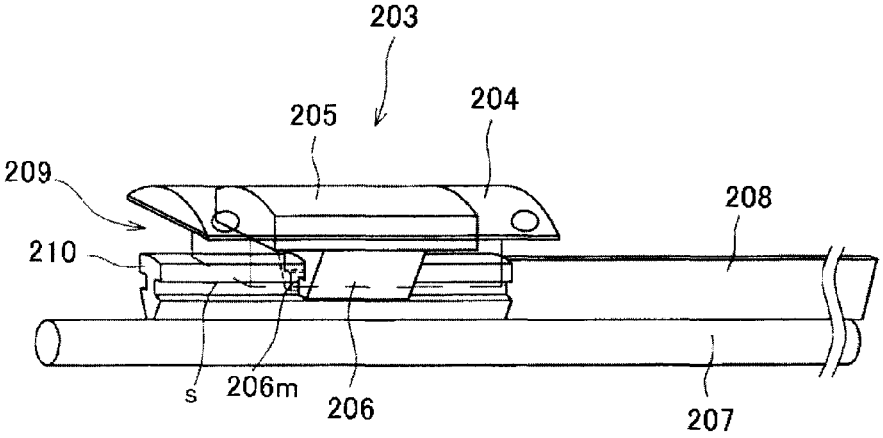
FIG. 14 is an explanatory diagram which describes an expanding and contracting mechanism of a machining unit.
Figure 15:
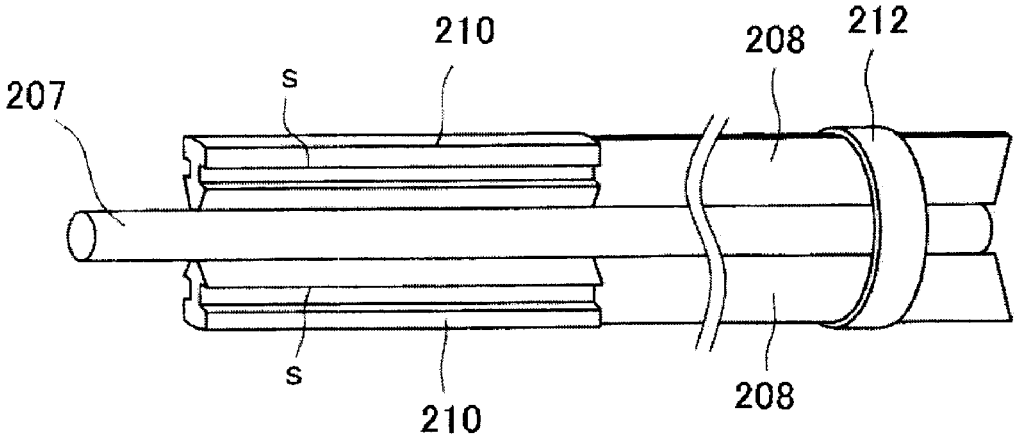
FIG. 15 is an explanatory diagram of a pair of drawbars which is disposed in symmetrical positions with respect to a tool axis which constitutes a center therebetween.

In the third exemplary embodiment, as shown in FIGS. 13 to 15, an inner surface grinding tool 201 as an arbor includes five coaxial machining units 203 which are incorporated within a tubular case 202. This inner surface grinding tool 201 is designed to machine simultaneously five semicircular journal bearing portions of a four-cylinder internal combustion engine 4 which is made up of a cylinder block $W_1$ and a lower block $W_2$ as shown in FIG. 44 with the cylinder block $W_1$ and the lower block $W_2$ fastened together.

In this embodiment, a pair of grinding blade portions 205 is disposed in symmetrical positions with respect to a tool axis which constitutes a center therebetween and the pair of grinding blade portions 205 is provided for one journal bearing portion j so as to be freely expanded or contracted. Part of a mechanism for expanding and contracting these grinding blade portions 205 is disposed in symmetrical positions with respect to the tool axis which constitutes a center therebetween as shown in FIG. 15. Radial bars 208, which function as drawbars constituting part of the mechanisms for expanding and contracting the grinding blade portions 205 of five machining units are disposed so as to be out of phase circumferentially around the tool axis which constitutes a center thereof as shown in FIG. 6.

When adjusting individually expansion amounts of the grinding blade portions 205 of the machining units 203 with a view to aligning machining finish dimensions, only the expanding and contracting mechanisms for the machining units 203 are controlled whose grinding blade portions 205 are to be so adjusted. The expanding and contracting mechanisms of all the machining units 203 are controlled simultaneously when the grinding tool 201 is inserted into or pulled out of a workpiece or cutting is implemented on machining target portions on the workpiece.

As shown in FIG. 14, the machining unit 203 includes a grinding blade portion holder 204 which is mounted at a predetermined portion of a tubular case 202 and the grinding blade portion 205 which is slidable in a radial direction of the tool axis relative to the grinding blade portion holder 204. A grinding blade (grinding stone) is mounted at an external surface portion of the grinding blade portion 205, and an engagement portion 206 including a dovetail groove 206*m* is provided inwards of the grinding blade portion 205.

In addition, a core shaft 207 is disposed at a center of the tool axis, and the radial bars 208 are disposed on a circumference of the core shaft 207 so as to slide in an axial direction along an outer surface of the core shaft 207. A sliding sloping member 210 is attached to a distal end portion of the radial bar 208 which fits in the dovetail groove 206*m* of the engagement portion 206. Sloping lines s of the sliding sloping member 210 which fits in the dovetail groove 206*m* are inclined relative to an axial direction, and in this embodiment, the sloping lines s are inclined so as to be slightly lower the left to the right as it extends as shown in FIG. 19(*a*).

Figure 19A:
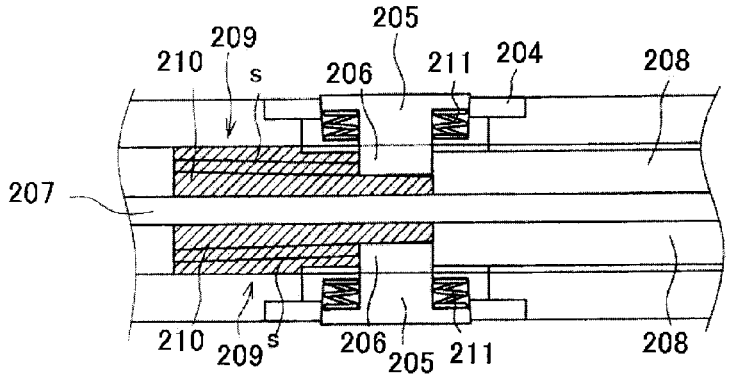
FIG. 19(*a*) shows the expanding and contracting mechanism in such a state that a diameter between grinding blade portions is contracted.
Figure 19B:
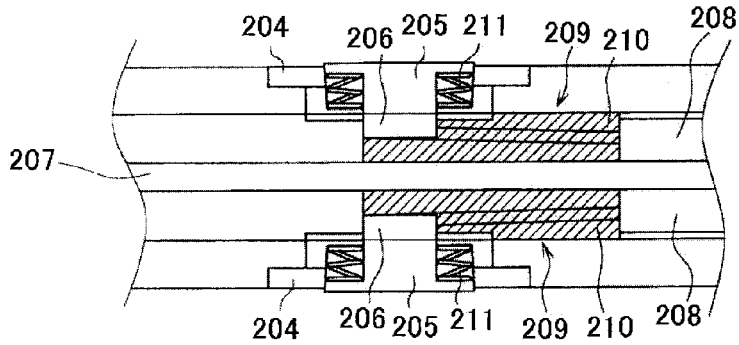

Because of this, in this embodiment, as shown in FIG. 19(*a*), when the radial bar 208 is caused to slide leftwards relative to the core shaft 20 in the figure, the engagement portion 206 moves to lower inclined portions of the sloping lines s whereby the grinding blade portion 205 is contracted diametrically inwards. On the other hand, as shown in FIG. 19(*b*), when the radial bar 208 is caused to slide rightwards relative to the core shaft 20 in the figure, the engagement portion 206 moves to higher inclined portions of the sloping lines s whereby the grinding blade portion 205 is expanded diametrically outwards. Namely, an expanding and contracting mechanism 209 is made up of the engagement portion 206 of the grinding blade portion and the sliding sloping member 210.

In this embodiment, the pair of grinding blade portions 205 and the pair of sliding sloping members 210 are disposed in the symmetrical positions with respect to the tool axis which constitutes the center therebetween at each machining unit 203, and a spring 211 is installed between the grinding blade portion holder 204 and the grinding blade portion 205 for absorbing looseness between the sliding sloping member 210 and the engagement portion 206.

Incidentally, the pair of sliding sloping members 210 which is disposed in the symmetrical positions with respect to the tool axis which constitutes the center therebetween is made to advance or retreat in synchronism with each other, and because of this, as shown in FIG. 15, the pair of radial bars 208 is fixed to a fixing ring 212 which is disposed so as to surround the perimeter of the radial bars 208.

Figure 16:
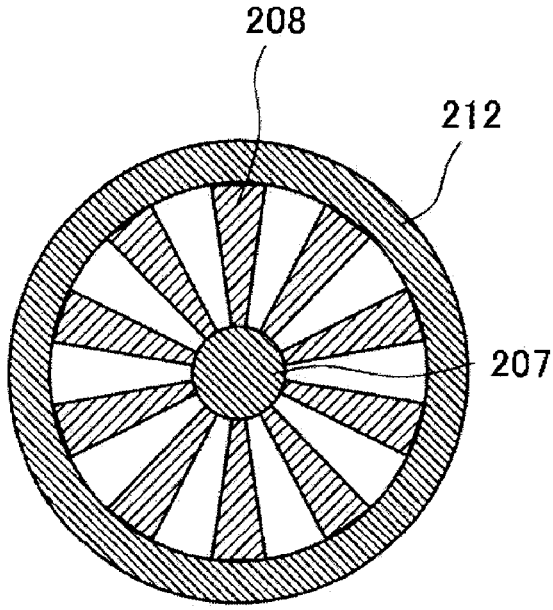
FIG. 16 is an explanatory diagram showing a relationship between the drawbars and a fixing ring.

The machining units 203, the sliding sloping members 210 thereof and the radial bars 208 are disposed so as to be circumferentially out of phase around the tool axis, and because of this, the radial bars 208 are disposed so that totally 10 radial bars are disposed at equal intervals along a circumferential direction of the core shaft 207, as shown in FIG. 16.

Totally five fixing rings 212 are provided for fixing the respective pair of radial bars 208 in the symmetrical positions. The pairs of radial bars 208 which are fixed by the corresponding fixing rings 212 are made to independently advance or retreat.

In this embodiment, although the pair of grinding blade portions 205 are provided in the symmetrical positions for each machining unit 203 and the pair of radial bars 208 and the pair of sliding sloping members 210 are provided so as to match the pair of grinding blade portion 205 so provided, three or more grinding blade portions 205 may be provided at each machining unit 203. As this occurs, the radial bars 208 and the sliding sloping members 210 are disposed around the tool axis at uniform angular intervals in the circumferential direction thereof and are made to advance or retreat together, with the engagement portion 206 of each grinding blade portion 205 brought into engagement with the corresponding sliding sloping member 210.

Figure 20:
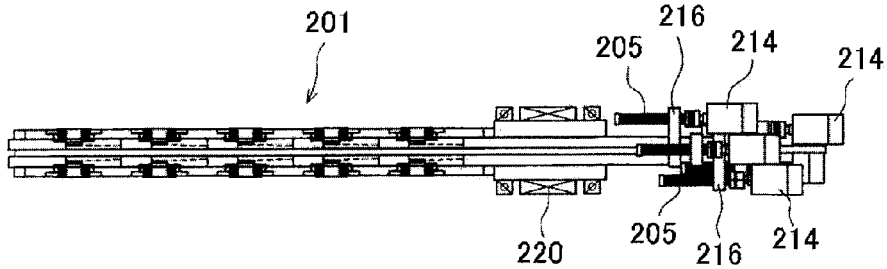
FIG. 20 is an explanatory diagram of the whole of a grinding system in which the inner surface grinding tool is mounted.

Hereinafter, a summary of an overall configuration of a grinding system in which the inner surface grinding tool 201 is mounted will be described based on FIG. 20 before an advancing and retreating mechanism for each pair of radial bars 208.

Figure 17:
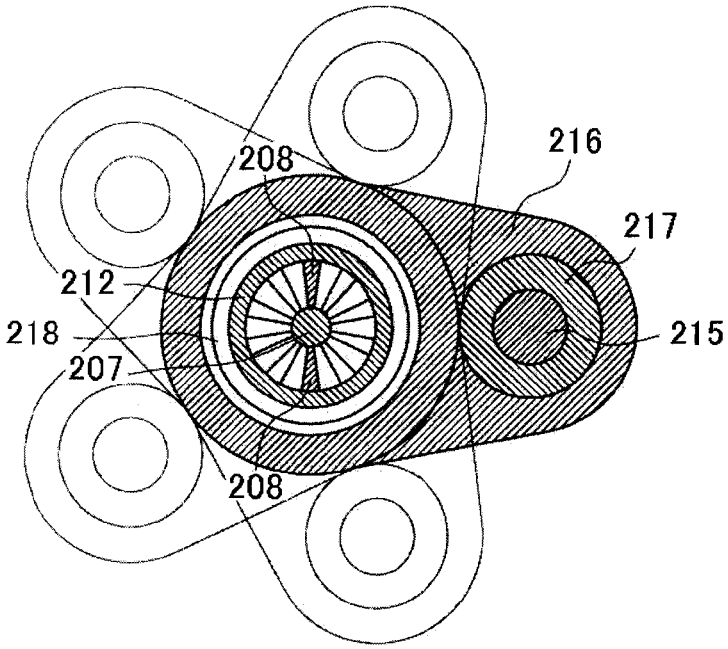
FIG. 17 is an explanatory diagram of a connecting member which connects the fixing ring and a ball screw.
Figure 18:
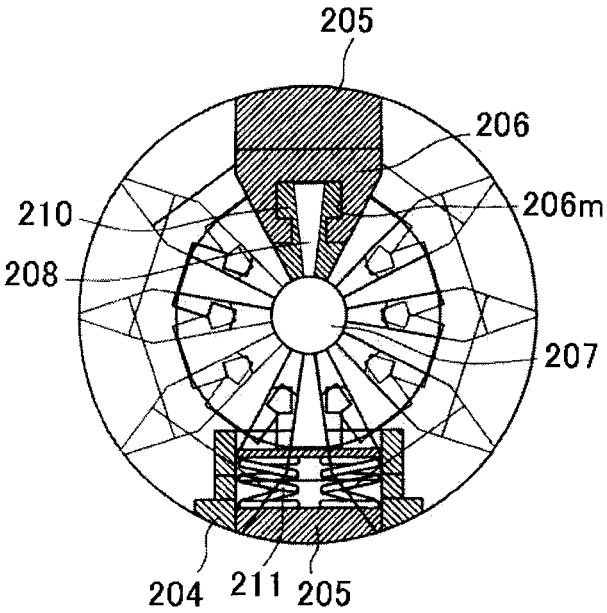
FIG. 18 is a vertical sectional view of a machining unit portion.

The grinding system includes five radial bar motors 214 which are disposed circumferentially around a central axis of a spindle motor 220 so as to be out of phase in the circumferential direction, five ball screws 215 which are driven to rotate independently by the radial bar motors 214, and five connecting members 216 which are individually brought into engagement with the ball screws 215. As shown in FIG. 17, a nut 217 which meshes with the ball screw 215 and a bearing 218 in which the fixing ring 212 is to be installed are provided at each connecting member 216. As has been described, the pair of radial bars 208 is fixed to each fixing ring 212.

Because of this, when the radial motor 214 at one specific portion is driven, the pair of radial bars 208 corresponding to the specific portion is caused to advance or retreat via the corresponding connecting member 218, whereby the grinding blade portions 205 at the machining unit 203 corresponding to the specific portion are expanded or contracted.

An NC control unit and a driver, which are not shown, are connected to each radial bar motor 214 so as to be controlled in an individual or linked fashion.

In machining the journal bearing portions of the four-cylinder internal combustion engine shown in FIG. 44, the grinding tool 201 is inserted into the journal bearing portions j which are defined by fastening the cylinder block W1 and the lower block W2 together in such a state that all the grinding blade portions 205 of the respective machining units 203 of the grinding tool 201 are contracted to be stored.

Then, when the insertion of the grinding tool 201 is completed, all the radial motors 214 are actuated to operate by a signal from the control unit so as to cause the grinding blade portions 205 of all the machining units 203 to slide diametrically outwards for expansion.

Although cutting is implemented by driving the spindle motor 220, a balanced machining becomes possible at each machining unit 203 due to the grinding blade portions 205 being positioned symmetrically, deflection by machining loads of the whole of the inner surface grinding tool 201 is reduced, and the rotational balance is made difficult to become out of order. This enables the grinding blade portions 205 to rotate at high speeds, as a result of which a reduction in machining time can be realized.

In a case where diameters of the finished machining target portions of the workpiece vary due to wear of the tool or the variation in rigidity at the machining target portions, since the expansion amounts of the grinding blade portions 205 of the individual machining units 203 can be controlled independently, the diameters of the finished machining target portions can be aligned constantly by the expanding and contracting mechanisms being combined with a function, for example, to measure finished diameters after the respective grinding blade portions 205 of the individual machining units 203 have been controlled for expansion so as to be fed back to individual target expansion diameters.

When the machining is completed, all the radial bar motors 214 are driven to cause the grinding blade portions 205 to slide diametrically inwards for contraction by a signal from the control unit, and thereafter, the grinding tool 201 is pulled out of the workpiece.

The variation in diametric accuracy of the plurality of machined holes can be suppressed by adopting the manner that has been described heretofore. Moreover, since the inner surface grinding tool 201 can be inserted into and pulled out of the workpiece with efficiency, the machining efficiency can be improved extremely well.

Fourth Exemplary Embodiment

Referring to FIGS. 21 to 29, a fourth exemplary embodiment of the invention will be described.

Figure 21:
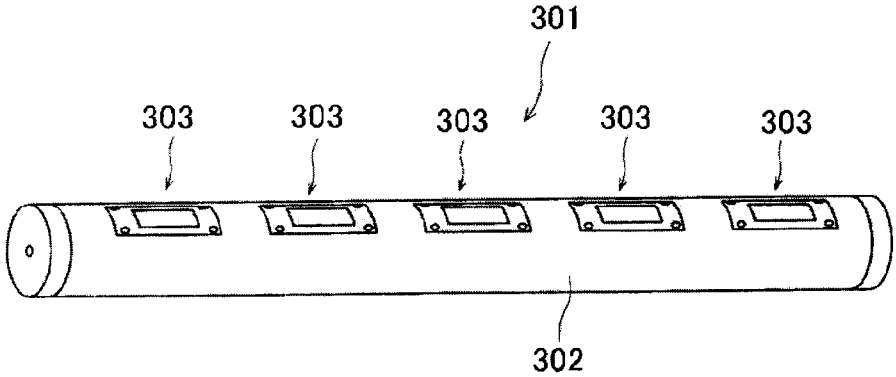
FIG. 21 is an external view of an inner surface grinding tool of a fourth exemplary embodiment.
Figure 22:
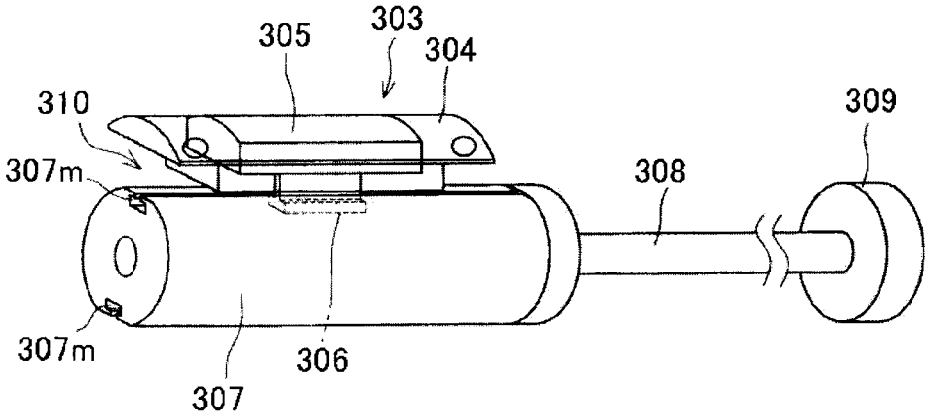
FIG. 22 is an explanatory diagram which describes an expanding and contracting mechanism of a machining unit.
Figure 23:
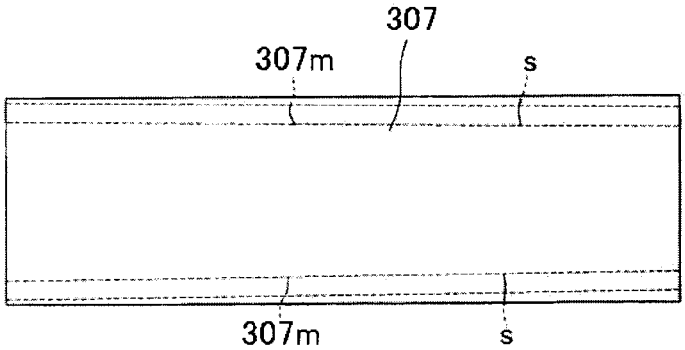
FIG. 23 is an explanatory diagram which describes a slope groove in a sliding slope member.

In the fourth exemplary embodiment, as shown in FIGS. 21 to 23, an inner surface grinding tool 301 as an arbor includes five coaxial machining units 303 which are incorporated within a tubular case 302 and is designed to machine simultaneously five semicircular journal bearing portions j of a four-cylinder internal combustion engine 4 as shown in FIG. 44 which is made up of a cylinder block $W_1$ and a lower block $W_2$ with the cylinder block $W_1$ and the lower block $W_2$ fastened together.

In this embodiment, a pair of grinding blade portions 305 is disposed in symmetrical positions with respect to a tool axis which constitutes a center therebetween and the pair of grinding blade portions 305 is provided for one journal bearing portion j so as to be freely expanded or contracted. Part of a mechanism for expanding and contracting these grinding blade portions 305 is disposed in symmetrical positions with respect to the tool axis which constitutes a center therebetween as shown in an explanatory diagram in FIG. 27.

When adjusting individually expansion amounts of the grinding blade portions 305 of the machining units 303 with a view to aligning machining finish dimensions, only the expanding and contracting mechanisms for the machining units 303 are controlled whose grinding blade portions 305 are to be so adjusted. The expanding and contracting mechanisms of all the machining units 303 are controlled simultaneously when the grinding tool 301 is inserted into or pulled out of a workpiece or cutting is implemented on machining target portions on the workpiece.

Figure 24:
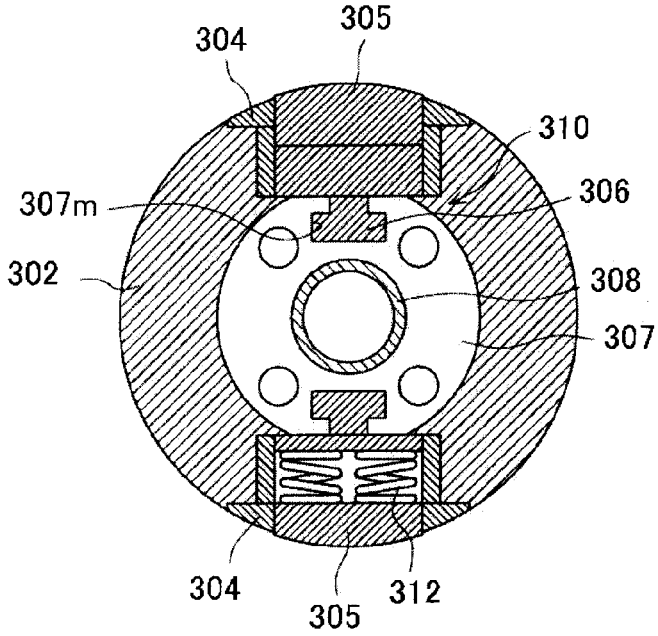
FIG. 24 is a vertical sectional view of a machining unit portion.

As shown in FIG. 24, the machining unit 303 includes on one grinding blade portion side thereof a grinding blade portion holder 304 which is mounted at a predetermined portion of a tubular case 302 and the grinding blade portion 305 which is slidable in a radial direction of the tool axis relative to the grinding blade portion holder 304. A grinding blade (grinding stone) is mounted at an external surface portion of the grinding blade portion 305, and an engagement portion 306 of a dovetail tenon type is provided inwards of the grinding blade portion 305.

A tubular sliding sloping member 307 is disposed at a central portion around the tool axis so that its axial center coincides with a center of the tool axis, and a draw pipe 308 functioning as a drawbar is attached integrally to a proximal end side of the sliding sloping member 307. A fixing ring 309 is attached to a proximal end portion of the draw pipe 308. The draw pipe 308 and the sliding sloping member 307 are made free to advance or retreat along an axial direction of the grinding tool 301 by an advancing and retreating mechanism, which will be described later.

In addition, sloping grooves 307*m* of a dovetail groove type are formed in symmetrical positions with respect to the tool axis which constitutes a center therebetween in an upper portion and a lower portion of the sliding sloping member 307, and the engagement portions 306 of the grinding blade portions 305 are fitted individually in the sloping grooves 307*m* for engagement therewith. As shown in FIG. 23, the sloping groove 307*m* is configured as an axially inclined sloping line s, and in this embodiment, the sloping line s is inclined so as to be gradually slightly lowered from the left to the right as it so extends.

Because of this, in this embodiment, when the sliding sloping member 307 is caused to slide leftwards in the figure, the engagement portions 306 move to lower inclined portions of the sloping lines s whereby the grinding blade portions 305 are contracted diametrically inwards. When the sliding sloping member 307 is caused to slide rightwards in the figure, the engagement portions 306 move to higher inclined portions of the sloping lines s whereby the grinding blade portions 305 are expanded diametrically outwards. Namely, an expanding and contracting mechanism 310 is made up of the engagement portions 306 of the grinding blade portions and the sloping grooves 307*m* of the sliding sloping member 307.

In addition, a spring 312 is installed between the grinding blade portion holder 304 and the grinding blade portion 305 for absorbing looseness between the sliding sloping member 307 and the engagement portion 306.

In the embodiment described above, the pair of sloping grooves 307*m*, which is symmetrical with each other with respect to the tool axis, is provided in each sliding sloping member 307, and the pair of grinding blade portions 305 is fitted individually in the pair of sloping grooves 307*m*. However, three or more sloping grooves 307 and grinding blade portions 305 may be disposed circumferentially at uniform angular intervals.

Incidentally, since all the sliding sloping members 307 are disposed coaxially at the five machining units 303, the draw pipes 308 are made up of tubular members having different diameters, and diameters of the draw pipes which are positioned farther apart from a thrust driving portion are made smaller so as to be inserted through the draw pipes 308 which are positioned nearer to the thrust driving portion and tubular interiors of the sliding sloping members 307. This state is clearly illustrated in FIG. 27 which shows the respective machining units 303 in an exploded fashion.

The individual sliding sloping members 307 are made free to move independently along the axial direction by the thrust driving portion via the corresponding draw pipes 308, and their driving mechanism will be described below.

Figure 25:
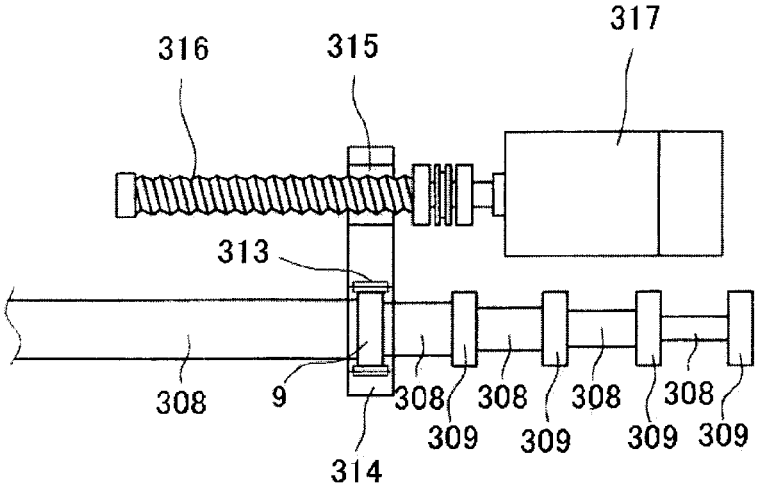
FIG. 25 is an explanatory diagram of an advancing and retreating mechanism of a draw pipe.
Figure 26:
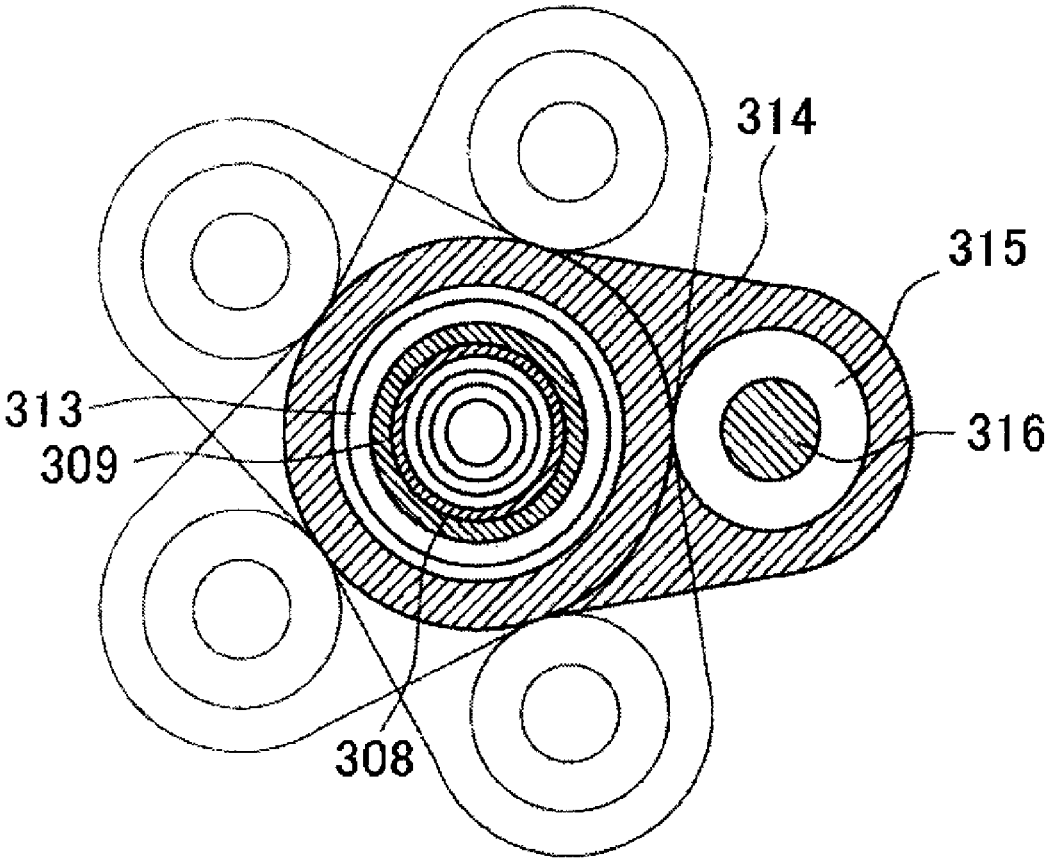
FIG. 26 is an explanatory diagram which connects a fixing ring and a ball screw.
Figure 27:
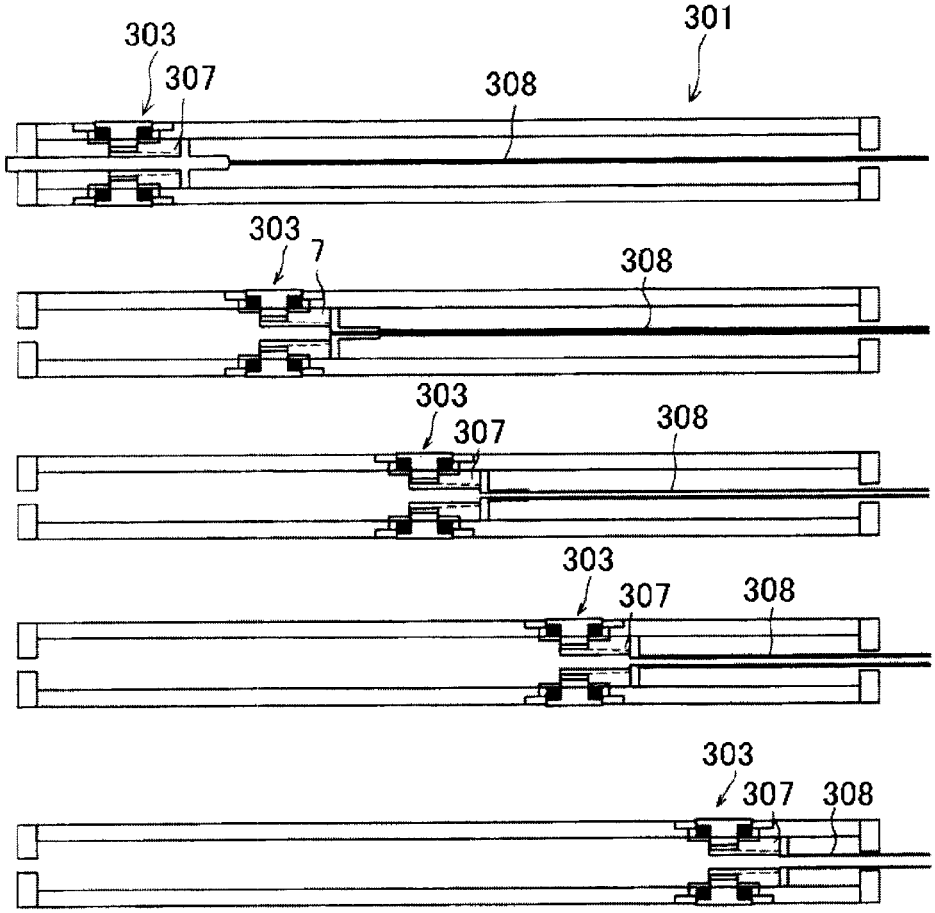
FIG. 27 is an explanatory diagram which shows the expanding and contracting mechanism of each machining unit in an exploded fashion.
Figure 28A:
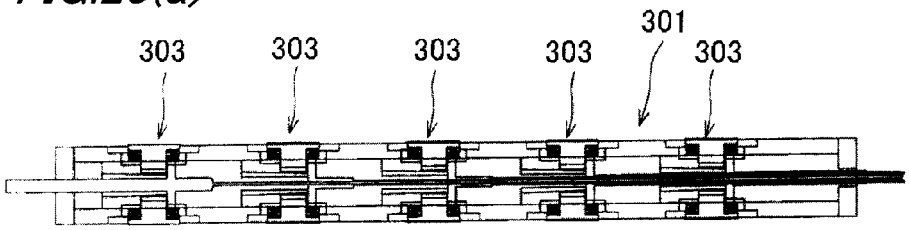
FIG. 28(*b*) shows the expanding and contracting mechanism in such a state that the diameter between the grinding blade portions is expanded.
Figure 28B:
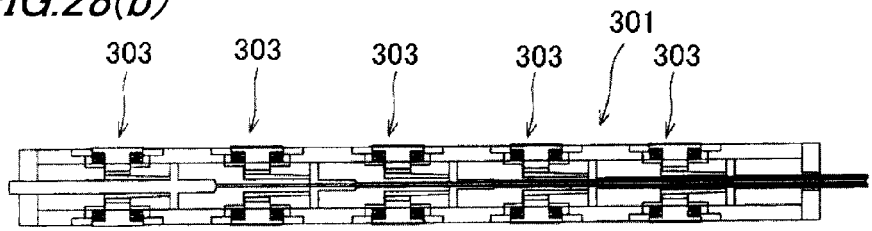

As has been described above, the fixing ring 309 is fixed to the proximal end portion of the draw pipe 308, and this fixing ring 309 is, as shown in FIGS. 25, 26, is connected to a connecting member 314 via a bearing 313. A nut 315, into which a ball screw 316 can be screwed, is mounted on the connecting member 314. Thus, five connecting members 314 are disposed for five fixing rings 309 so as to be circumferentially out of phase with one another.

The ball screws 316 are made free to rotate independently by corresponding draw pipe motor 317.

Because of this, when the draw pipe motor 317 at any specific machining portion 303 in the five machining portions 303 is driven, the corresponding sliding sloping member 307 is caused to advance or retreat via the corresponding connecting member 314, whereby the pair of grinding blade portions 305 of the specific machining portion 303 is expanded or contracted.

Figure 29:
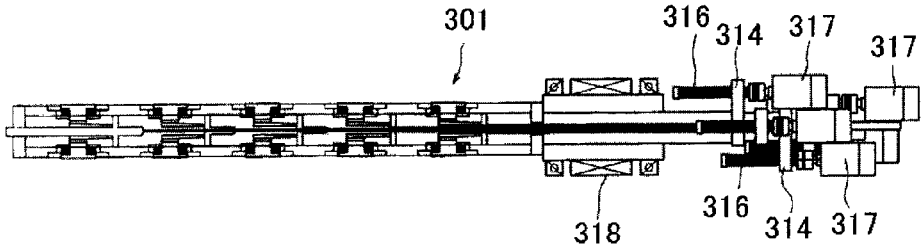
FIG. 29 is an explanatory diagram of the whole of a grinding to system in which the inner surface grinding tool is mounted.

A summary of an overall configuration of a grinding system is shown in FIG. 29. The grinding system includes the five draw pipe motors 317 which are disposed around a central axis of the spindle motor 318 so as to be circumferentially out of order with one another, the five ball screws 316 which are driven to rotate independently by the corresponding draw pipe motors 317 and the five connecting members 314 into which the ball screws 316 are screwed via the corresponding nuts 315. The fixing rings 309 are attached to the corresponding the connecting members 314 via the corresponding bearings 313.

An NC control unit and a driver, which are not shown, are connected to each draw pipe motor 317 so as to be controlled in an individual or linked fashion.

In machining the journal bearing portions of the four-cylinder internal combustion engine shown in FIG. 44, the grinding tool 301 is inserted into the journal bearing portions j which are defined by fastening the cylinder block $W_1$ and the lower block $W_2$ together in such a state that all the grinding blade portions 305 of the respective machining units 303 of the grinding tool 301 are contracted to be stored.

Then, when the insertion of the grinding tool 301 is completed, all the draw pipe motors 317 are actuated to operate by a signal from the control unit so as to cause the grinding blade portions 305 of all the machining units 303 to slide diametrically outwards for expansion.

Although cutting is implemented by driving the spindle motor 318, a balanced machining becomes possible at each machining unit 303 due to the grinding blade portions 305 being positioned symmetrically, deflection by machining loads of the whole of the inner surface grinding tool 301 is reduced, and the rotational balance is made difficult to become out of order. This enables the grinding blade portions 305 to rotate at high speeds, as a result of which a reduction in machining time can be realized.

In a case where diameters of the finished machining target portions of the workpiece vary due to wear of the tool or the variation in rigidity at the machining target portions, since the expansion amounts of the grinding blade portions 305 of the individual machining units 303 can be controlled independently, the diameters of the finished machining target portions can be aligned constantly by the expanding and contracting mechanisms being combined with a function, for example, to measure finished diameters after the respective grinding blade portions 305 of the individual machining units 303 have been controlled for expansion so as to be fed back to individual target expansion diameters.

When the machining is completed, all the draw pipe motors 317 are driven to cause the grinding blade portions 305 to slide diametrically inwards for contraction by a signal from the control unit, and thereafter, the grinding tool 301 is pulled out of the workpiece.

The variation in diametric accuracy of the plurality of machined holes can be suppressed by adopting the manner that has been described heretofore. Moreover, since the inner surface grinding tool 301 can be inserted into and pulled out of the workpiece with efficiency, the machining efficiency can be improved extremely well.

Fifth Exemplary Embodiment

Referring to FIGS. 30 to 37, a fifth exemplary embodiment of the invention will be described.

In the fifth exemplary embodiment, as shown in FIGS. 30 to 37, an inner surface grinding tool 401 as an arbor includes five coaxial machining units 403 which are incorporated within a tubular case 402 and is designed to machine simultaneously five semicircular journal bearing portions j of a four-cylinder internal combustion engine 4 as shown in FIG. 44 which is made up of a cylinder block $W_1$ and a lower block $W_2$ with the cylinder block $W_1$ and the lower block $W_2$ fastened together.

Figure 35A:
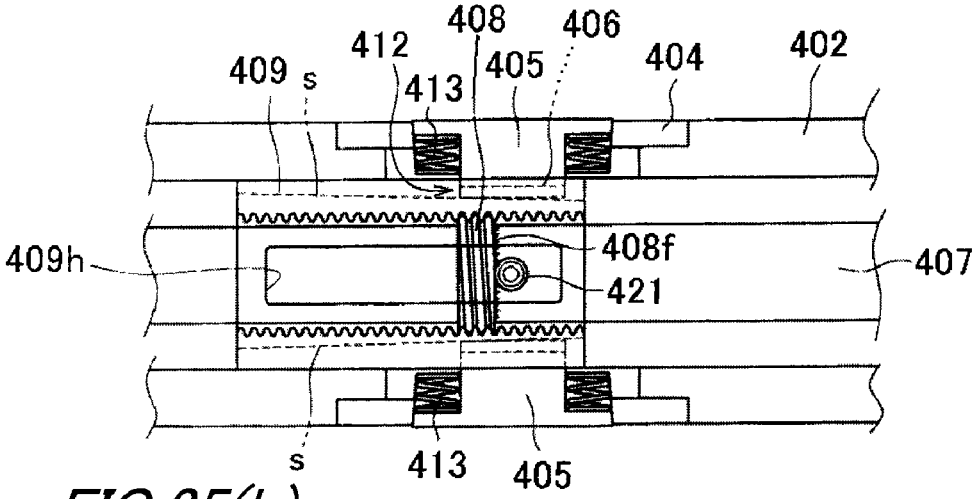
FIG. 35(*a*) is a functional diagram showing the function of the sliding slope member through driving by a pinion gear driving portion, which shows a state in which a diameter between grinding blade portions is contracted.
Figure 35B:
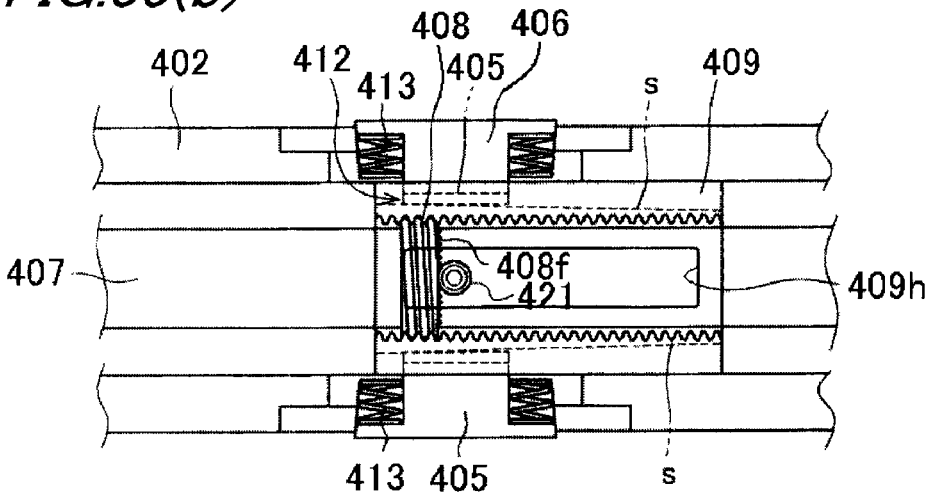

Basically, a pair of grinding blade portions 405 is disposed in symmetrical positions with respect to a tool axis which constitutes a center therebetween and the pair of grinding blade portions 405 is provided for one journal bearing portion j so as to be freely expanded or contracted. Part of a mechanism for expanding and contracting these grinding blade portions 405 is disposed in symmetrical positions with respect to the tool axis which constitutes a center therebetween as shown in FIG. 35.

When adjusting individually expansion amounts of the grinding blade portions 405 of the machining units 403 with a view to aligning machining finish dimensions, only the expanding and contracting mechanisms for the machining units 403 are controlled whose grinding blade portions 405 are to be so adjusted. However, the expanding and contracting mechanisms of all the machining units 403 are controlled simultaneously when the grinding tool 401 is inserted into or pulled out of a workpiece or cutting is implemented on machining target portions on the workpiece.

Figure 31:
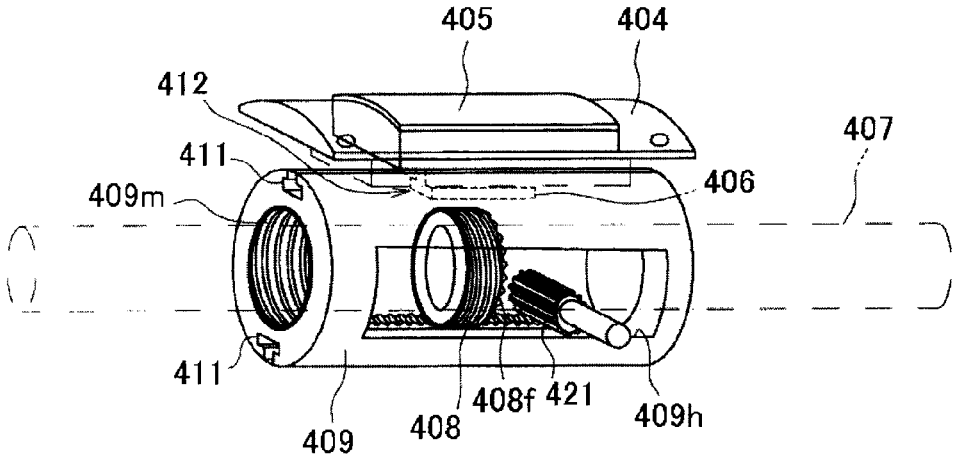
FIG. 31 is an explanatory diagram which describes an expanding and contracting mechanism of a machining unit.

As shown in FIG. 31, the machining unit 403 includes on one grinding blade portion side thereof a grinding blade portion holder 404 which is mounted at a predetermined portion of a tubular case 402 and the grinding blade portion 405 which is slidable in a radial direction of the tool axis relative to the grinding blade portion holder 404. A grinding blade (grinding stone) is mounted at an external surface portion of the grinding blade portion 405, and an engagement portion 406 of a dovetail tenon type is provided inwards of the grinding blade portion 405.

On the other hand, a core shaft 407 is disposed at a central portion of the tool axis so that an axial center thereof coincides with a center of the tool axis and the core shaft 407 is made free to advance or retreat by a simultaneous driving mechanism, which will be described later. Externally threaded members 408 are provided at five portions of the core shaft 407 which correspond to machining target portions on a workpiece so as to rotate around an axis of the core shaft 407 but not to move in an axial direction thereof. A tubular sliding sloping member 409 having an internally threaded portion 409*m* is disposed around a circumference of each of the externally threaded members 408, and an externally threaded portion of the externally threaded member 408 and the internally threaded portion 409*m* of the sliding sloping member mesh with each other.

Figure 32:
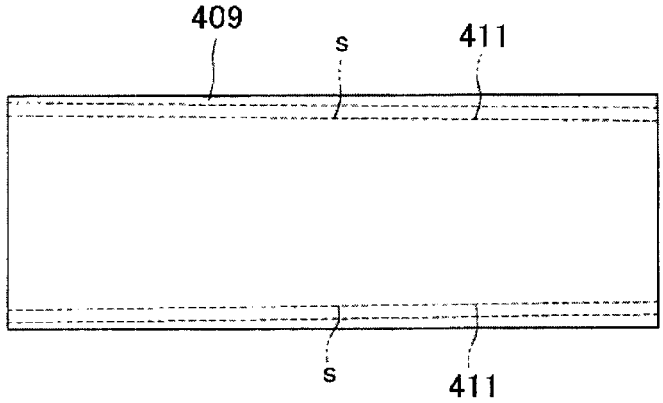
FIG. 32 is an explanatory diagram which describes a slope groove in a sliding slope member.
Figure 33:
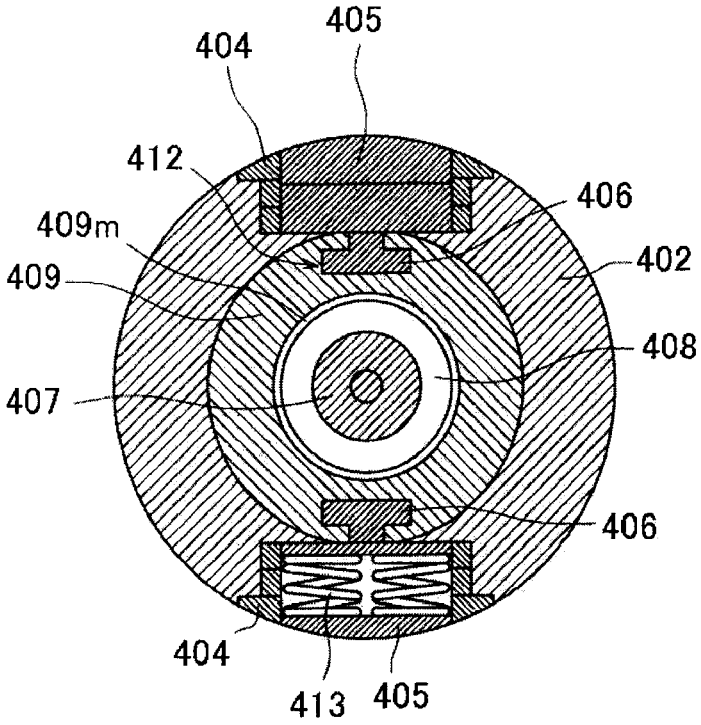
FIG. 33 is a vertical sectional view of a machining unit portion.

Sloping grooves 411 of a dovetail groove are formed in symmetrical positions with respect to the tool axis constituting a center therebetween at an upper end portion and a lower end portion of the sliding sloping member 409, and the engagement portions 406 of the grinding blade portions 405 are fitted individually in the sloping grooves 411 for engagement therewith, whereby an expanding and contracting mechanism 412 is configured. As shown in FIG. 32, the sloping groove 411 is configured as a sloping line s which is inclined in the axial direction, and in this embodiment, the sloping line s is inclined so as to be gradually slightly lowered from the left to the right as it extends so.

Because of this, in this embodiment, when the sliding sloping member 409 is caused to slide leftwards in the figure, the engagement portions 406 move to lower inclined portions of the sloping lines s whereby the grinding blade portions 405 are contracted diametrically inwards. When the sliding sloping member 409 is caused to slide rightwards in the figure, the engagement portions 406 move to higher inclined portions of the sloping lines s whereby the grinding blade portions 405 are expanded diametrically outwards. Namely, the expanding and contracting mechanism 412 is made up of the engagement portions 406 of the grinding blade portions and the sloping grooves 411 of the sliding sloping member 409.

In addition, a spring 413 is installed between the grinding blade portion holder 404 and the grinding blade portion 405 for absorbing looseness between the sliding sloping member 409 and the engagement portion 406.

In the embodiment described above, the pair of sloping grooves 411 of the sliding sloping member 409 and the pair of grinding blade portions 405 are provided in the symmetrical positions with respect to the tool axis which constitutes the center therebetween. However, three or more sloping grooves 411 and grinding blade portion 405 may be provided at uniform angular intervals in a circumferential direction.

Incidentally, an overall configuration of a grinding system in which the inner surface grinding tool 401 is mounted will be described based on FIG. 37 before a simultaneous advancing and retreating mechanism is described which advances and retreats the five sliding sloping members 409 along the axial direction altogether at one time.

According to the overall configuration of the grinding system in which the inner surface grinding tool 401 is mounted, the system includes the core shaft 407 which is disposed so as to extend from the center of the tool axis to penetrate through a central portion of a spindle motor 414, a connecting member 415 which is connected to a proximal end portion of the core shaft 407, a ball screw 409 which screws into a nut, not shown, which is installed in the other end side of the connecting member 415 and a core shaft motor 416 for driving to rotate the ball screw 419. When the ball screw 419 rotates by being driven by the core shaft motor 416, the connecting member 415 and the core shaft 407 are made to advance or retreat in the axial direction.

Then, when the core shaft 407 advances or retreats, the five externally threaded members 408 and the sliding sloping members 409 which screw on the corresponding externally threaded members 408 advance or retreat together with the core shaft 407, whereby the grinding blade portions 405 at all the machining units 403 are expanded or contracted. Because of this, a simultaneous driving mechanism 417 is made up of the core shaft motor 416, the connecting member 415 and the core shaft 407.

In addition, in this system, an individual driving mechanism 418 is provided for advancing or retreating individually the sliding sloping members 409, and hereinafter, this individual driving mechanism 418 will be described.

Figure 34:
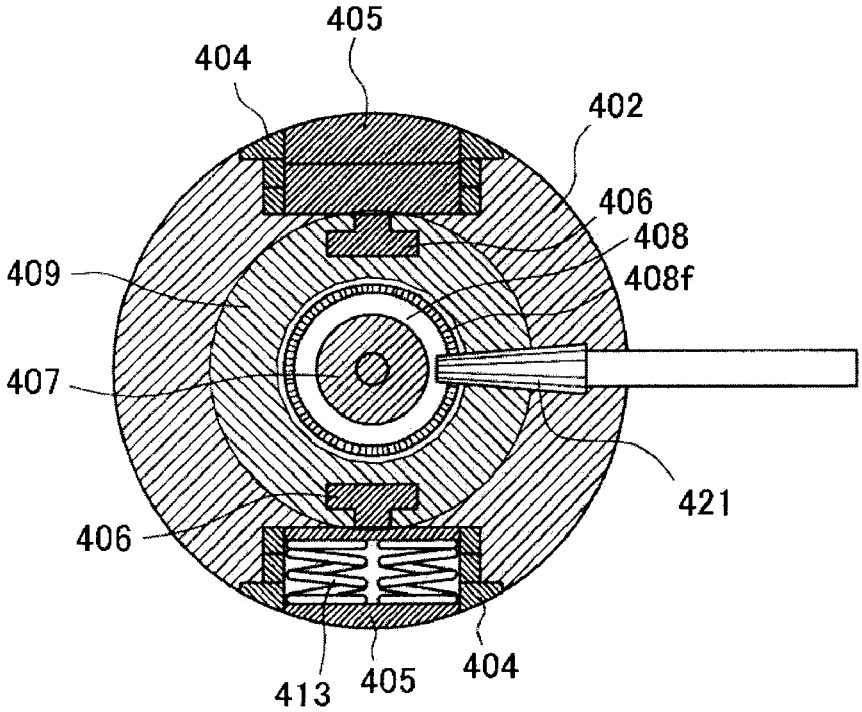
FIG. 34 is an explanatory diagram which shows a meshing engagement state between a face gear of an externally threaded member and a pinion gear.

As shown in FIG. 31, an opening 409*h* is formed in a lateral side of the sliding sloping member 409, and an annular face gear 408*f*, which is also shown in FIG. 34, is formed on a circumferential edge portion on a rear side of the externally threaded member 408.

Figure 30:
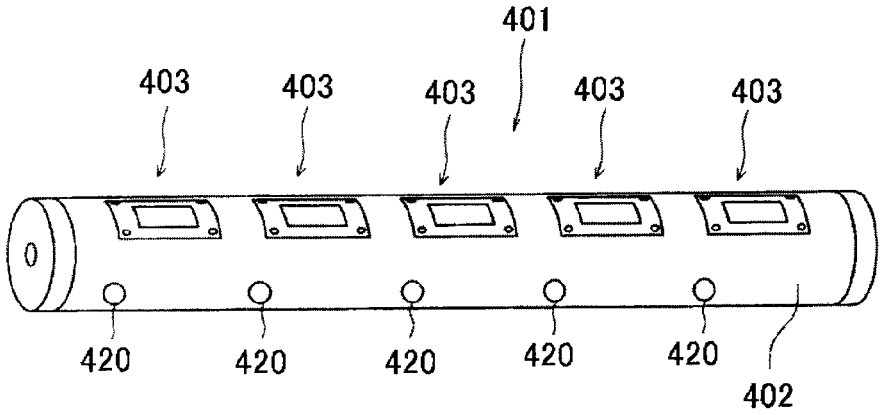
FIG. 30 is an external view of an inner surface grinding tool of a fifth exemplary embodiment.

As shown in FIG. 30, insertion holes 420 are provided in a lateral side of the tubular case 402 through which pinion gears 421 can be inserted towards the face gears 408*f* of the externally threaded members 408. The pinion gears 421 of the individual driving mechanism 418, which will be described below, can be inserted from the insertion holes 420 so as to be brought into meshing engagement with the corresponding face gears 408*f*.

Figure 37:
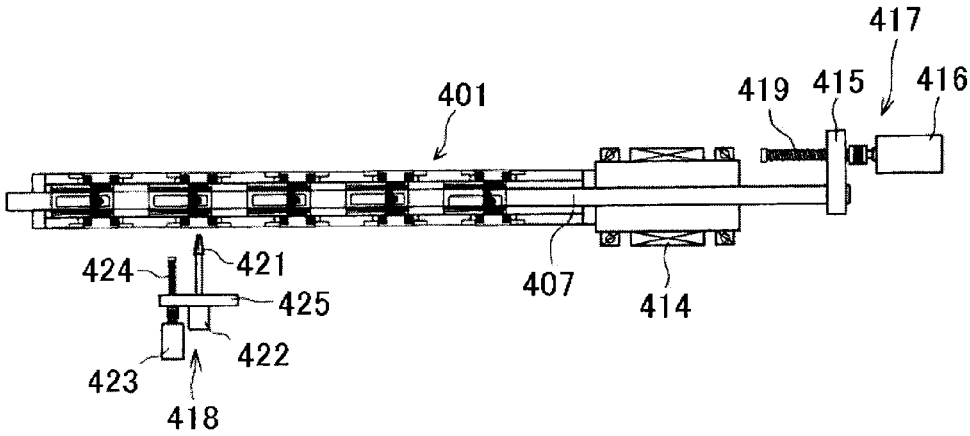
FIG. 37 is an explanatory diagram of the whole of a grinding system in which the inner surface grinding tool is mounted.

As shown in FIG. 37, the individual driving mechanism 418 includes a pinion gear motor 422 for driving the pinion gear 421 and a pinion gear screwing motor 423 for advancing or retreating the pinion gear 421. A ball screw 424 is attached to an output shaft of the pinion gear screwing motor 423. A nut, not shown, which is installed in a connecting member 425 is in mesh engagement with the ball screw 424. The pinion gear motor 422 is integrally fixed to the connecting member 425.

Because of this, by driving the pinion gear screwing motor 423, the pinion gear 421 advances so as to be brought into mesh engagement with the face gear 408*f* of the externally threaded member 408 through the insertion hole 420 in the tubular case 402. By driving the pinion gear motor 422 in that state, the externally threaded member 408 is rotated to thereby cause the sliding sloping member 409 to advance or retreat independently.

As this occurs, since the opening 409*h* formed in the lateral side of the sliding sloping member 409 is formed to extend long in the axial direction, there is no risk of the sliding sloping member 409 interfering with the pinion gear 421.

Figure 36A:
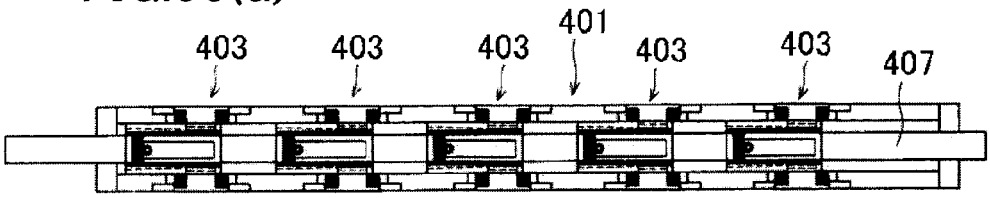
FIG. 36(*a*) shows the whole of the tool in a waiting state.
Figure 36B:
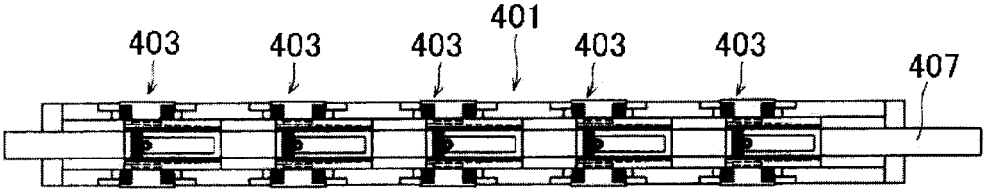

In machining the journal bearing portions of the four-cylinder internal combustion engine shown in FIG. 44, the core shaft 407 is caused to advance by the simultaneous driving mechanism 417, and the grinding tool 401 described heretofore is inserted into the journal bearing portions j which are defined by fastening the cylinder block $W_1$ and the lower block $W_2$ together in such a state that all the grinding blade portions 405 of the respective machining units 403 of the grinding tool 401 are contracted to be stored, as shown in FIG. 36(*a*).

Then, when the insertion of the grinding tool 401 is completed, the core shaft 407 is caused to retreat by the simultaneous driving mechanism 417, so that all the sliding sloping members 409 are caused to retreat to thereby cause the grinding blade portions 405 of all the machining units 403 to slide diametrically outwards for expansion.

Although cutting is implemented by driving the spindle motor 414, a balanced machining becomes possible at each machining unit 403 due to the grinding blade portions 405 being positioned symmetrically, deflection by machining loads of the whole of the inner surface grinding tool 401 is reduced, and the rotational balance is made difficult to become out of order. This enables the grinding blade portions 405 to rotate at high speeds, as a result of which a reduction in machining time can be realized.

In a case where diameters of the finished machining target portions of the workpiece vary due to wear of the tool or the variation in rigidity at the machining target portions, the spindle motor 414 is made to stop rotating, and the sliding sloping members 409 are positioned in their original positions. Then, the pinion gears 421 of the individual driving mechanisms 418 are inserted through the insertion holes 420 in the lateral side of the tubular case 402 which correspond to the machining units 403 so as to be brought into mesh engagement with the corresponding face gears 408*f* of the externally threaded member 408, thereby making it possible to control expansion amounts of the grinding blade portions 405 individually. In addition, since this series of steps can be repeated for each machining unit 403, the diameters of the finished machining target portions can be aligned constantly by the individual driving mechanisms 418 being combined with a function, for example, to measure finished diameters after the respective grinding blade portions 405 of the individual machining units 403 have been controlled for expansion so as to be fed back to individual target expansion diameters.

When the machining is completed, all the sliding sloping members 409 are caused to advance or retreat by the simultaneous driving mechanism 417 to thereby cause the grinding blade portions 405 to slide diametrically inwards for contraction, and thereafter, the grinding tool 401 is pulled out of the workpiece.

The variation in diametric accuracy of the plurality of machined holes can be suppressed by adopting the manner that has been described heretofore. Moreover, since the inner surface grinding tool 401 can be inserted into and pulled out of the workpiece with efficiency, the machining efficiency can be improved extremely well.

Sixth Exemplary Embodiment

Referring to FIGS. 38 to 44, a sixth exemplary embodiment of the invention will be described.

Figure 38:
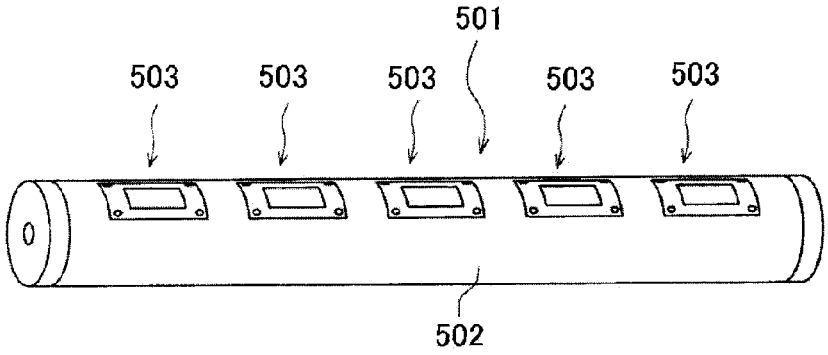
FIG. 38 is an external view of an inner surface grinding tool of a sixth exemplary embodiment.
Figure 39A:
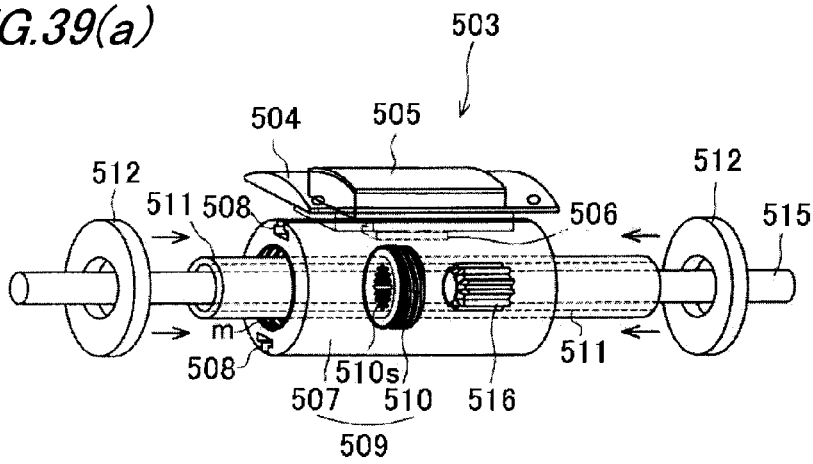
FIG. 39(*a*) shows an expanding and contracting mechanism in an assembled state.
Figure 39B:
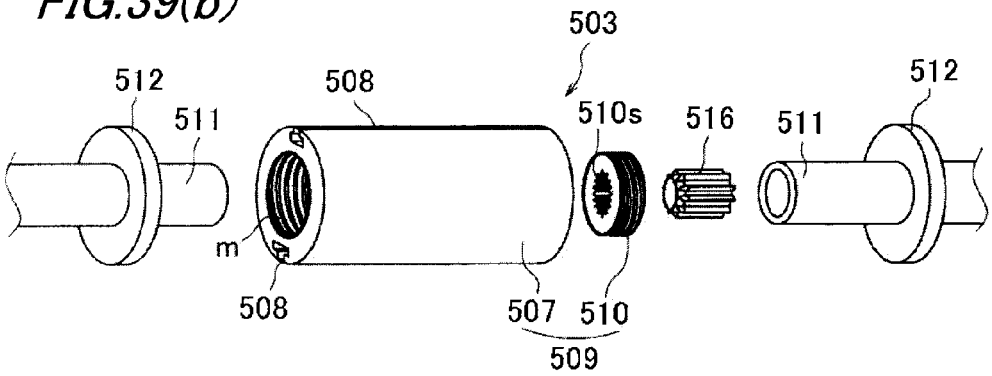
Figure 40:
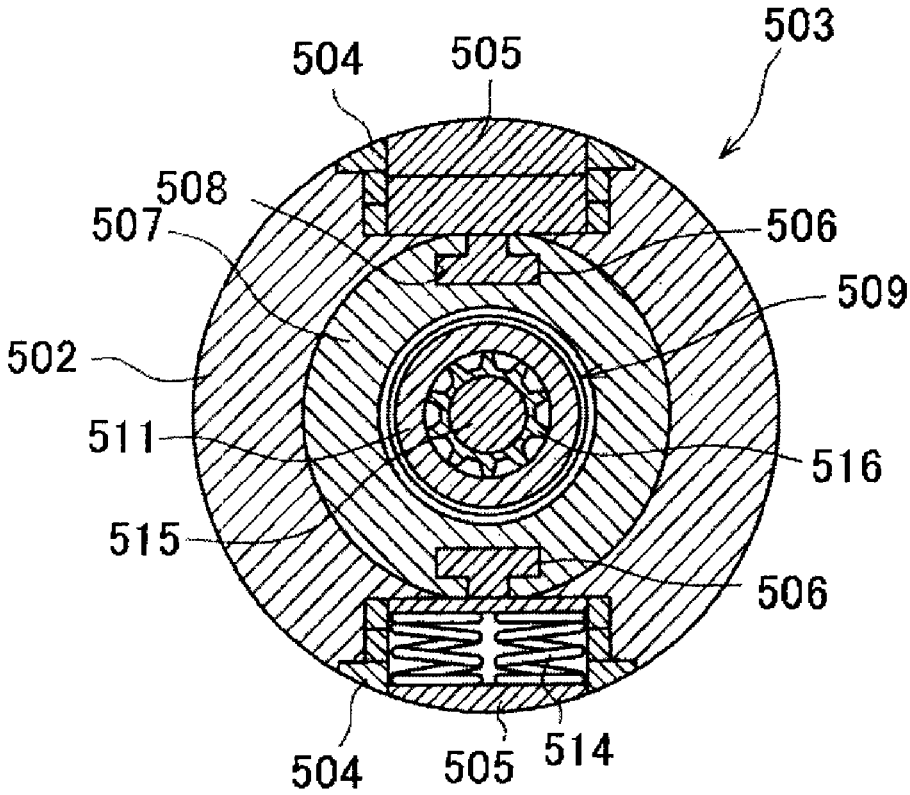
FIG. 40 is a vertical sectional view of a machining unit portion.

In the sixth exemplary embodiment, as shown in FIGS. 38 to 40, an inner surface grinding tool 501 as an arbor includes five coaxial machining units 503 which are incorporated within a tubular case 502 and is designed to machine simultaneously five semicircular journal bearing portions j of a four-cylinder internal combustion engine 4 as shown in FIG. 44 which is made up of a cylinder block $W_1$ and a lower block $W_2$ with the cylinder block $W_1$, and the lower block $W_2$ fastened together.

In this embodiment, a pair of grinding blade portions 505 is disposed in symmetrical positions with respect to a tool axis which constitutes a center therebetween and the pair of grinding blade portions 505 is provided for one journal bearing portion j so as to be freely expanded or contracted. Mechanisms for expanding and contracting these grinding blade portions 505 are disposed in symmetrical positions with respect to the tool axis which constitutes a center therebetween.

When adjusting individually expansion amounts of the grinding blade portions 505 of the machining units 503 with a view to aligning machining finish dimensions, only the expanding and contracting mechanisms for the machining units 503 are controlled whose grinding blade portions 505 are to be so adjusted. The expanding and contracting mechanisms of all the machining units 503 are controlled simultaneously when the grinding tool 501 is inserted into or pulled out of a workpiece or cutting is implemented on machining target portions on the workpiece.

A peripheral construction of the grinding blade portion 505 of the machining unit 503 will be described. As shown in FIGS. 39(*a*), 40, the machining unit 503 includes grinding blade portion holders 405 which are mounted at predetermined portions of the tubular case 502 and the grinding blade portions 505 which are made free to slide in a radial direction of the tool axis relative to the grinding blade portion holders 504. A grinding blade (grinding stone) is attached to an external surface portion of the grinding blade portion 505, and engagement portions 506 of a dovetail tenon type are provided inwards of the grinding blade portions 505.

A sliding sloping member 507 having sloping grooves 508 of a dovetail groove type are disposed is disposed inwards of the grinding tool 501 in a position where the grinding blade portion 505 lies so as to slide in the axial direction. The engagement portion 506 of the grinding blade portion 505 is fitted in the sloping groove 508 for engagement therewith. An internally threaded portion m is formed at a central portion of the sliding sloping member 507, and an outer circumferential thread portion of an externally threaded member 510 which includes a splined hole portion 510*s* at a central portion thereof screws in the internally threaded portion m. A threaded speed reduction mechanism 509 is made up of the sliding sloping member 507 and the externally threaded member 510.

In addition, for the externally threaded member 510 to be held in an axial constant position, spacer tubes 511 are disposed in front of and behind the externally threaded member 510 so as to hold the externally threaded member 510 therebetween, and the spacer tubes 511 are borne, respectively, by two bearing members 512 which are fixed individually to ends of the externally threaded member 510. Although the spacer tubes 511 shown in FIG. 39(*a*) are illustrated as being shorter than their actual length for the purpose of explanation, in reality, they are spacers for keeping the adjacent externally threaded members 510 at predetermined intervals and are long members.

Figure 41A:
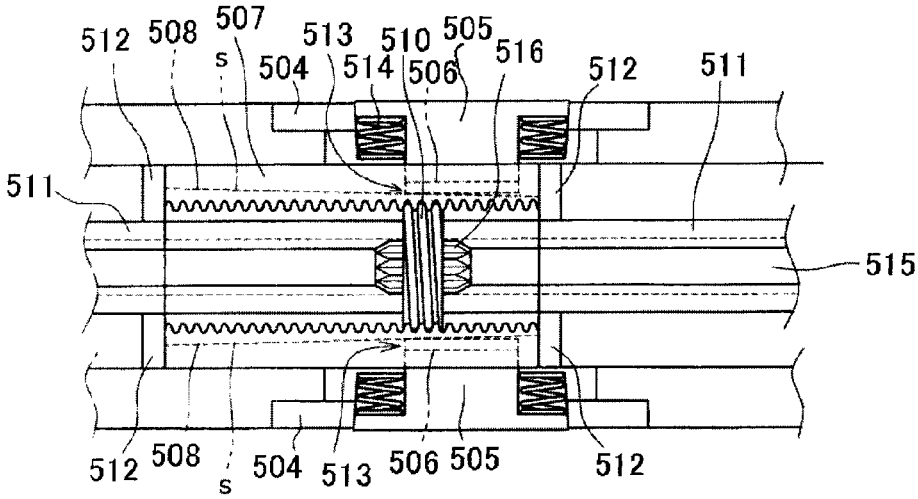
FIG. 41(*a*) shows the expanding and contracting mechanism in such a state that a diameter between grinding blade portions is contracted.
Figure 41B:
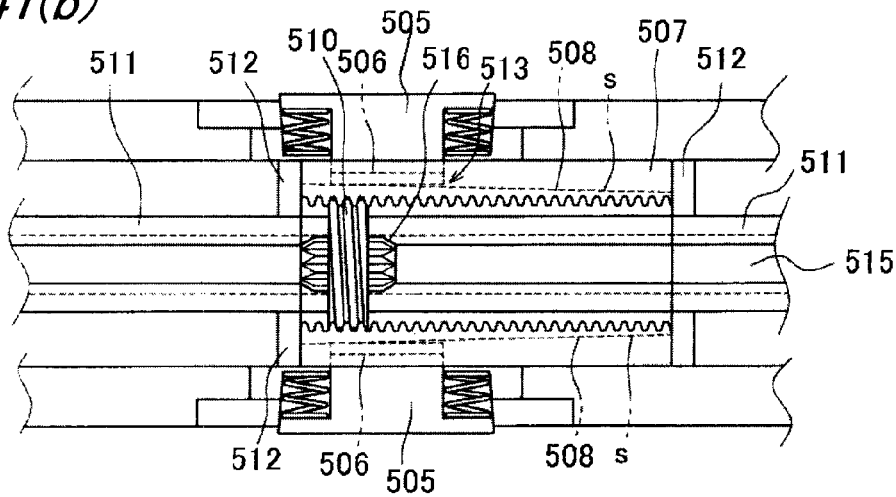
Figure 42:
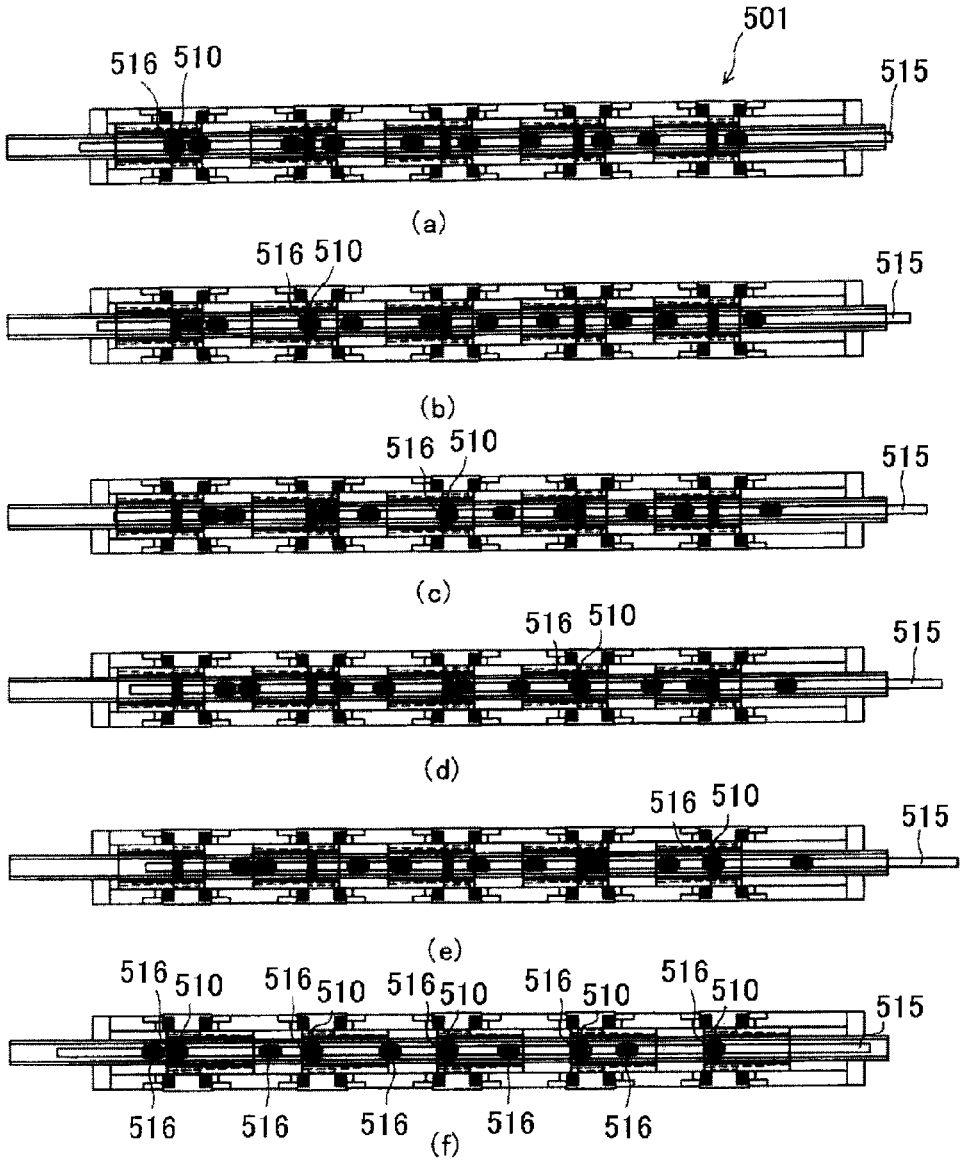
FIG. 42 is an explanatory diagram which describes changes in a spline fitting mode between the sliding amount of the control shaft and spline pieces.

In this embodiment, the pair of sloping grooves 508 is formed in symmetrical positions with respect to the tool axis which constitutes a center therebetween, and as is also shown in FIG. 41, the sloping grooves 508 are configured as sloping lines s which is inclined along the axial direction. In this embodiment, the sloping line s is inclined so as to be gradually slightly lowered from the left to the right as it so extends, Because of this, in this embodiment, as shown in FIG. 42(*a*), when the sliding sloping member 507 is caused to move leftwards in the figure, the engagement portions 506 move to lower inclined portions of the sloping lines s whereby the grinding blade portions 505 are contracted diametrically inwards. In contrast, as shown in FIG. 41(*b*), when the sliding sloping member 507 is caused to move rightwards in the figure, the engagement portions 506 move to higher inclined portions of the sloping lines s whereby the grinding blade portions 505 are expanded diametrically outwards. Namely, the expanding and contracting mechanism 513 is made up of the engagement portions 506 of the grinding blade portions and the sloping grooves 508 of the sliding sloping member 507.

In addition, a spring 514 is installed between the grinding blade portion holder 504 and the grinding blade portion 505 for absorbing looseness between the sliding sloping member 507 and the engagement portion 506. In the embodiment, the pair of sloping grooves 508 of the sliding sloping member 507 and the pair of grinding blade portions 505 are provided in the symmetrical positions with respect to the tool axis which constitutes the center therebetween. However, three or more sloping grooves 508 and grinding blade portion 505 may be provided at uniform angular intervals in a circumferential direction.

Incidentally, a control shaft 515 is disposed at a central portion of the tool axis so that an axial center thereof coincides with a center of the tool axis and is made free to advance or retreat by a driving mechanism, which will be described later. Spline pieces 516 each having a spline portion at an outer circumferential portion are mounted at predetermined potions of the control shaft 515.

The numbers of spline pieces 516 to be disposed and mounting positions thereof are double the number of machining units or are, as shown in FIG. 42, such that totally 10 spline pieces 516 are provided for the five machining units 503, that is, two spline pieces 516 for each machining unit 503. In the spline pieces 516, the five spline pieces (=primary spline pieces) are disposed at regular intervals which are equal to those at which the machining unit 503 are disposed, and the other five spline pieces (=secondary spline pieces) are disposed in such a way that only the spline pieces 516 at the specific portions are spline fitted in the externally threaded members 510 at the specific portions and the other spline pieces 516 are made not to be brought into engagement with the externally threaded embers 510 at any of the five portions.

Namely, a situation shown at (f) in FIG. 42 represents a state in which the control shaft 515 is located in a position where all the five spline pieces 516 (the primary spline pieces) which are disposed at regular intervals are fitted individually in the five externally threaded members 510. Situations shown at (a) to (e) in FIG. 42 individually represent states in which the control shaft 515 is caused to slide so that only one of the other five spline pieces 516 (the secondary spline pieces) is made to be fitted in one of the externally threaded members 510, starting with the leftmost externally threaded member 510 A towards the rightmost externally threaded member 510 in a sequential fashion.

Because of this, when all the spline pieces 516 are spline fitted in all the externally threaded members 510 so as to transmit rotations of the corresponding spline pieces 516, the grinding blade portions 505 of all the machining units 503 can be expanded or contracted altogether at one time. In addition, when the rotation of the specific spline piece 516 is transmitted to only the machining unit 503 at the specific portion, only the grinding blade portion 505 of the machining unit 503 at the specific portion can be expanded or contracted independently.

Figure 43:
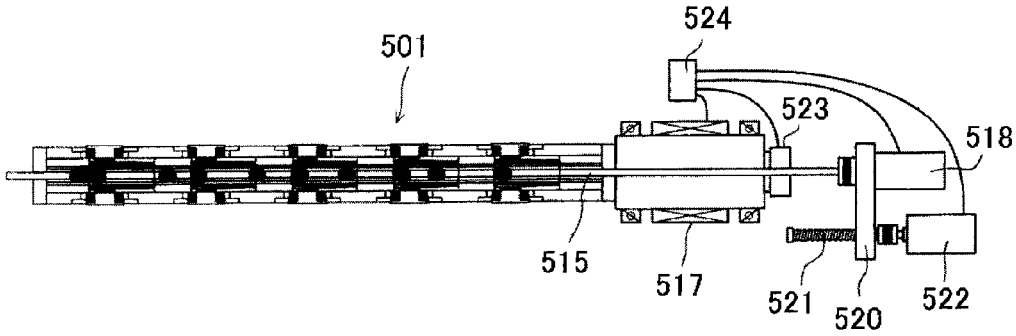
FIG. 43 is a configuration example diagram of the whole of a system in which the inner surface grinding tool is mounted.

Next, an overall configuration of a grinding system will be described based on FIG. 43 in which the grinding tool 501 is mounted.

According to the overall configuration of the grinding system in which the inner surface grinding tool 501 is mounted, the grinding system includes the control shaft 515 which is disposed so as to extend from the center of the tool axis so as to penetrate through a central portion of a spindle motor 517, a control shaft motor 518 for rotating the control shaft 515 in synchronism with the rotation of the spindle motor 517, a connecting member 520 which is mounted on the control shaft 515, a ball screw 521 which screws into a nut, not shown, which is installed in the connecting member 520, and a thrust motor 522 for driving to rotate the ball screw 521. The control shaft 515 advances or retreats by driving the thrust motor 522.

An encoder 523 for detecting a rotation of the spindle motor 517 is disposed on a central axis of the arbor so as to be directly connected thereto. An NC controller 524 is provided for processing a pulse transmitted thereto from the encoder 523 for synchronously controlling the controls shaft motor 518, and the thrust motor 522 and the spindle motor 517 are designed to be controlled by the NC controller 524.

As this occurs, although the NC controller 524 controls the rotation of the control shaft motor 518 in synchronism with the rotation of the spindle motor 517, since, in such a state that the rotations of the control shaft motor 518 and the spindle motor 517 are in complete synchronism with each other, no difference in phase is produced between the externally threaded members 510 and the internally threaded portions m of the sliding sloping members 507, the sliding sloping members 507 are kept staying still. Then, in the event that there is caused a difference in rotation therebetween by putting the rotations of the two motors minutely out of phase with each other, the sliding sloping members 507 are allowed to advance or retreat so as to allow the grinding blade portions 505 to be expanded or contracted.

As this occurs, the expanding or contracting amount of the grinding blade portions 517 is in proportion to the difference in phase of rotational speed between the tool 501 and the control shaft 515. As an example of a rotational speed control like what has been described above, for example, assuming that pReso1=pulse resolution of the spindle encoder, pReso2=pulse resolution of the control shaft encoder, V1=rotational speed value of the spindle shaft (the number of pluses generated by the encoder per unit time), V2=rotational speed value of the control shaft (the number of pulses generated by the encoder per unit time), tAdj=expansion amount of the grinding blade portion (a radius), and k=expansion amount of the grinding blade portion per rotation of the sliding sloping member (a value converted into the pReso2 pulse resolution), the rotational speed (V2) of the control shaft motor 506 is controlled so as to establish the following two expressions (1), (2).

$$(V1 \times pReso2) - (V2 \times pReso1) + (tAdj \times k) = 0 \quad (1)$$

$$V2 = \frac{(V1 \times pReso2) + (tAdj \times k)}{pReso1} \quad (2)$$

As this occurs, since V1 and V2 represent the numbers of pulses generated from the respective encoders per unit time, in the event that the resolutions are different, resulting values are different even though rotational speeds are the same.

In addition, the constant k is calculated as expressed by the following expression (3) from the thread pitch per rotation of the sliding sloping member and the sloping angle of the sloping groove portion 508 (the expansion amount to the sliding amount of the grinding blade portion). In the following expression, let's assume that pSq=thread pitch of the internally threaded portion m and θ=sloping angle of the sliding groove 508.

$$k = \frac{pReso2}{pSq \times \tan\theta} \quad (3)$$

In machining journal bearing portions of a four-cylinder internal combustion engine as shown in FIG. 44, the inner surface grinding tool 501, which as been described above, is inserted into journal bearing portions j which are defined by fastening the cylinder block $W_1$ and the lower block $W_2$ together in such a state that the control shaft 515 is caused to slide by the thrust motor 522 so that all the spline pieces 516 are spline fitted in the externally threaded members 510 to thereby cause the sliding sloping members 507 to slide, whereby all the grinding blade portions 505 of the machining units 503 of the grinding tool 510 are contracted so as to be stored.

Then, when the insertion of the inner surface grinding tool 501 is completed, the control shaft 515 is caused to slide by the thrust motor 522, and as is shown at (f) in FIG. 42, all the spline pieces 516 are spline fitted in all the externally threaded member 510, so as to cause the sliding sloping members 507 to side in the predetermined direction, whereby the grinding blade portions of all the machining units 503 are expanded diametrically outwards.

Although cutting is implemented by driving the spindle motor 517, a balanced machining becomes possible at each machining unit 503 due to the grinding blade portions 505 being positioned symmetrically, deflection by machining loads of the whole of the inner surface grinding tool 501 is reduced, and the rotational balance is made difficult to become out of order. This enables the grinding blade portions 505 to rotate at high speeds, as a result of which a reduction in machining time can be realized.

In a case where diameters of the finished machining target portions of the workpiece vary due to wear of the tool or the variation in rigidity at the machining target portions, the control shaft 515 is caused to slide by means of control by the NC controller 524, so that only the desired spline piece 516 is spline fitted in the desired externally threaded member 510, whereby the sliding sloping member 507 is caused to slide so as to allow the grinding blade portions 505 of the machining units 503 which corresponds to the sliding sloping member 507 to be expanded or contracted for adjustment. Because of this, the diameters of the finished machining target portions can be aligned constantly by the expanding and contracting mechanisms being combined with a function, for example, to measure finished diameters after the respective grinding blade portions 505 of the individual machining units 503 have been controlled for expansion so as to be fed back to individual target expansion diameters.

When the machining is completed, all the sliding sloping members 507 are caused to advance or retreat to thereby cause the grinding blade portions 505 to slide diametrically inwards for contraction. Thereafter, the inner surface grinding tool 501 is pulled out of the workpiece.

The variation in diametric accuracy of the plurality of machined holes can be suppressed by adopting the manner that has been described heretofore. Moreover, since the inner surface grinding tool 501 can be inserted into and pulled out of the workpiece with efficiency, the machining efficiency can be improved extremely well.

While the invention has been described by reference to the specific exemplary embodiments, it is obvious to those skilled in the art that various alterations and/or modifications can be added thereto without departing from the spirit and scope of the invention.

For example, types of workpieces constitute one example of such alterations and/or modifications.

DESCRIPTION OF REFERENCE NUMERALS AND SIGNS

1 inner surface grinding tool; 3 machining unit; 5 control unit; 12 motor with speed reduction gear; 13 externally threaded member; 14 internally threaded tube; 16 sloping groove portion; 17 grinding blade portion; 18 engagement portion; 101 inner surface grinding tool; 103 machining unit; 106 control shaft; 107 control unit; 114 electromagnetic clutch; 115 threaded speed reduction mechanism; 117 grinding blade portion; 119 expanding and contracting mechanism;

201 inner surface grinding tool; 203 machining unit; 205 grinding blade portion; 208 radial bar; 209 expanding and contracting mechanism; 210 sliding sloping member;

301 inner surface grinding tool; 303 machining unit; 305 grinding blade portion; 307 sliding sloping member; 308 draw pipe; 310 expanding and contracting mechanism;

401 inner surface grinding tool; 403 machining unit; 405 grinding blade portion; 408 externally threaded member; 48*f* face gear; 409 sliding sloping member; 412 expanding and contracting mechanism; 417 simultaneous driving mechanism; 418 individual driving mechanism; 412 pinion gear; 422 pinion gear motor;

501 inner surface grinding tool; 503 machining unit; 505 grinding blade portion; 509 threaded speed reduction mechanism; 515 control shaft; 516 spline piece

What is claimed is:

1. An inner surface grinding tool comprising:

a plurality of machining units for simultaneously machining respective inner surfaces of a plurality of portions of a workpiece, the plurality of machining units including expanding and contracting mechanisms and grinding blade portions, wherein rotation of the grinding blade portions defines a tool axis, the expanding and contracting mechanisms including externally threaded members, internally threaded members that travel along the tool axis due to rotation of the externally threaded members, and engagement portions that are provided on the grinding blade portions and brought into engagement with sloping portions of the internally threaded members, wherein outer diameters of the grinding blade portions are individually expanded or contracted by the rotations of the externally threaded portions.

2. The inner surface grinding tool according to claim 1, wherein the machining units respectively further include motors constituting power sources for rotating the respective externally threaded members, and wherein the motors are configured to be individually controlled.

3. The inner surface grinding tool according to claim 2, further comprising: a tubular case, wherein the motors, the externally threaded members and the internally threaded members are disposed within an inner tube of the tubular case, and wherein the grinding blade portions are held in the tubular case and move in a radial direction of the tubular case for expansion or contraction.

4. The inner surface grinding tool according to claim 1, further comprising: a control shaft which is rotatably disposed around an axial center of the inner surface grinding tool, wherein the machining units respectively include electromagnetic clutches for engaging and disengaging connections between the control shaft and the respective externally threaded members, and wherein, when a rotation of the control shaft is transmitted to the respective externally threaded members by connecting the control shaft and the externally threaded members via the electromagnetic clutches, the outer diameters of the grinding blade portions are individually expanded or contracted by the expanding and contracting mechanisms.

5. The inner surface grinding tool according to claim 4, wherein the rotation of the control shaft is controlled so as to synchronize with or shift a phase with a rotational speed of the grinding tool.

6. The inner surface grinding tool according to claim 1, further comprising:

a control shaft capable of advancing and retreating along a direction of a tool axis; and a plurality of spline pieces provided for the respective machining units and mounted on the control shaft, wherein the plurality of spline pieces are disposes so that the all spline pieces are simultaneously brought into engagement with the all externally threaded members by advancing or retreating the control shaft.

7. The inner surface grinding tool according to claim 1, further comprising:

a control shaft capable of advancing and retreating along a direction of a tool axis; and a plurality of spline pieces provided for the respective machining units and mounted on the control shaft, wherein the plurality of spline pieces are disposed so that any specific spline piece of the spline pieces is individually brought into engagement with a specific threaded speed reduction mechanism in accordance with a sliding position of the control shaft.

8. The inner surface grinding tool according to claim 1, further comprising:

a control shaft capable of advancing and retreating along a direction of a tool axis;

a plurality of primary spline pieces provided for the respective machining units and mounted on the control shaft, and a plurality of secondary spline pieces provided for the respective machining units and mounted on the control shaft, wherein the primary spline pieces are disposes so that the all primary spline pieces are simultaneously brought into engagement with the all externally threaded members by advancing and retreating the control shaft, and wherein the secondary spline pieces are disposed so that any specific secondary spline piece of the secondary spline pieces is individually brought into engagement with a specific threaded speed reduction mechanism in accordance with a sliding position of the control shaft.

9. The inner surface grinding tool according to claim 1, wherein, in each of the machining units, the grinding blade portion includes two or more blades which are provided at uniform angular intervals in a circumferential direction of a tool axis.

10. An inner surface grinding tool comprising:

a plurality of machining units for simultaneously machining respective inner surfaces of a plurality of portions of a workpiece, the plurality of machining units including expanding and contracting mechanisms and grinding blade portions, wherein rotation of the grinding blade portions defines a tool axis, the expanding and contracting mechanisms including sliding sloping members that advance and retreat along the tool axis, sloping portions formed at outer circumferential portions of the sliding sloping members and engagement portions provided on the grinding blade portions and brought into engagement with the sloping portions, and wherein outer diameters of the grinding blade portions are individually expanded or contracted by the respective expanding and contracting mechanisms;

a simultaneous driving mechanism for causing all of the sliding sloping members to advance or retreat altogether at one time; and an individual driving mechanism for causing the individual sliding sloping members to advance or retreat independently.

11. The inner surface grinding tool according to claim 10, wherein the individual driving mechanism includes a plurality of pinion gears respectively brought in mesh with face gears of respective externally threaded members brought in mesh with internally threaded portions of the sliding sloping members.

12. The inner surface grinding tool according to claim 11, wherein the simultaneous driving mechanism includes a core shaft capable of advancing and retreating along the direction of the tool axis, and wherein the respective externally threaded members are rotatable around an axis of the core shaft and unmovable in an axial direction of the core shaft.

* * * * *